US011203908B2

(12) United States Patent
Al Hussin

(10) Patent No.: US 11,203,908 B2
(45) Date of Patent: Dec. 21, 2021

(54) ANCHOR DEVICE

(71) Applicant: C6 TECHNOLOGIES AS, Stavanger (NO)

(72) Inventor: Husam Al Hussin, Sandnes (NO)

(73) Assignee: C6 Technologies AS, Stavanger (NO)

( * ) Notice: Subject to any disclaimer, the term of this patent is extended or adjusted under 35 U.S.C. 154(b) by 0 days.

(21) Appl. No.: 17/044,638

(22) PCT Filed: Mar. 29, 2019

(86) PCT No.: PCT/NO2019/050066
§ 371 (c)(1),
(2) Date: Oct. 1, 2020

(87) PCT Pub. No.: WO2019/194680
PCT Pub. Date: Oct. 10, 2019

(65) Prior Publication Data

US 2021/0108474 A1 Apr. 15, 2021

(30) Foreign Application Priority Data

Apr. 3, 2018 (GB) ..... 1805433
Apr. 3, 2018 (NO) ..... 20180443

(51) Int. Cl.
*E21B 23/01* (2006.01)
*E21B 33/129* (2006.01)
(Continued)

(52) U.S. Cl.
CPC ..... *E21B 23/01* (2013.01); *E21B 23/00* (2013.01); *E21B 33/128* (2013.01); *E21B 33/129* (2013.01); *E21B 33/1291* (2013.01)

(58) Field of Classification Search
CPC .... E21B 23/01; E21B 33/1291; E21B 33/129; E21B 23/00; E21B 33/128
See application file for complete search history.

(56) References Cited

U.S. PATENT DOCUMENTS 1,875,583 A * 9/1932 Fox ..... F42D 1/22 166/299
2,170,284 A * 8/1939 Eastman ..... E21B 23/01 166/117.6
(Continued)

FOREIGN PATENT DOCUMENTS

WO 2009037657 A1 3/2009
WO 2012154686 A1 11/2012
(Continued)

OTHER PUBLICATIONS

GB Search Report, dated Aug. 29, 2018 for GB application No. GB1805433.8 filed Apr. 3, 2018, pgs. 4.
(Continued)

*Primary Examiner* — Yong-Suk (Philip) Ro
(74) *Attorney, Agent, or Firm* — Chamberlain Hrdlicka

(57) ABSTRACT

An anchor device having a tubular body with a longitudinal axis, the tubular body being divided into a first body portion and a second body portion which are interconnected by means of a rigid connection so that movement between the first body portion and second body portion is substantially prevented, the anchor device further comprising an actuator having an actuation part which, by operation of the actuator, moves relative to the body, wherein the anchor device further comprises a first linkage set and second linkage set each of which includes at least one linkage, each linkage comprising a first, second and third link, the second link lying between the first and third links, and being pivotally connected to both, each linkage further comprising means to releasably pivotally connect the first link to the first body portion, and means to releasably pivotally connect the third link to the actuation part, the first and third links of each linkage in the first set being shorter than the first and third links of each linkage in the second set, and the second link
(Continued)

Figure 1:
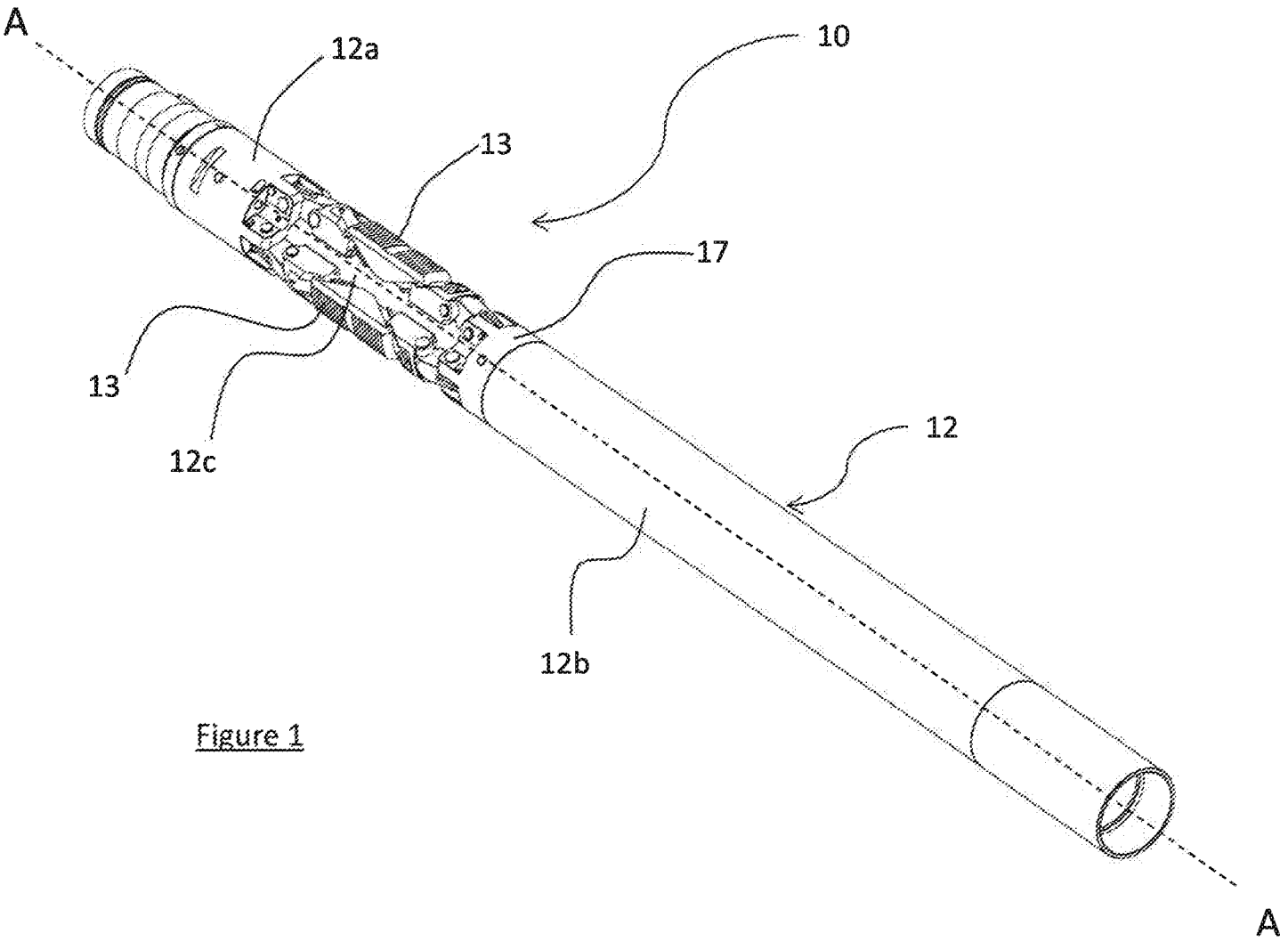

of each linkage in the first set being longer than the second link of each linkage in the second set.

16 Claims, 18 Drawing Sheets

(51) Int. Cl.
*E21B 33/128* (2006.01)
*E21B 23/00* (2006.01)

(56) References Cited

U.S. PATENT DOCUMENTS 3,661,205 A 5/1972 Belorgey
4,616,703 A * 10/1986 Laurent ..... E21B 23/01 166/66.4
5,184,676 A * 2/1993 Graham ..... E21B 4/18 166/66.4
5,765,640 A 6/1998 Milne
7,178,602 B2 2/2007 Hiorth
7,886,834 B2 * 2/2011 Spencer ..... E21B 33/129 166/382
9,482,067 B2 * 11/2016 Dewars ..... E21B 33/00
2004/0031606 A1 * 2/2004 Xu ..... E21B 17/1021 166/213
2007/0175629 A1 * 8/2007 Harris ..... E21B 23/01 166/117.6
2007/0181298 A1 8/2007 Sheiretov
2009/0071659 A1 3/2009 Spencer et al.
2010/0163251 A1 7/2010 Mock
2011/0277990 A1 * 11/2011 Kotsonis ..... E21B 23/01 166/217
2014/0174761 A1 6/2014 Spencer
2014/0374119 A1 12/2014 Dewars
2015/0354313 A1 12/2015 Mcclinton
2015/0376967 A1 * 12/2015 Bloom ..... E21B 17/20 166/98
2017/0067305 A1 3/2017 Robertson
2017/0183928 A1 6/2017 Herrera
2017/0268301 A1 9/2017 Porta
2019/0078406 A1 * 3/2019 Scruggs ..... E21B 29/00
2019/0271201 A1 * 9/2019 Robertson ..... E21B 23/01

FOREIGN PATENT DOCUMENTS

WO 2014174288 A1 10/2014
WO 2014178725 A1 11/2014
WO 2017029621 A1 2/2017

OTHER PUBLICATIONS

NO Search Report, dated Oct. 29, 2018 for NO appllication No. 20180443 filed Apr. 3, 2018, pgs. 2.

* cited by examiner

Standard ID Sizes Sorted Smallest to Largest (mm)

| T/C SN | ID (mm) | OD (in) | LINK CLASS |
|---|---|---|---|
| 1 | 95.26 | 5 1/2 | CL1 |
| 2 | 97.18 | 4 1/2 | |
| 3 | 98.46 | 5 1/2 | |
| 4 | 99.56 | 4 1/2 | |
| 5 | 101.60 | 4 1/2 | |
| 6 | 101.60 | 5 | |
| 7 | 101.60 | 5 1/2 | |
| 8 | 102.72 | 5 | |
| 9 | 102.92 | 4 1/2 | |
| 10 | 103.88 | 4 1/2 | |
| 11 | 104.80 | 5 1/2 | |
| 12 | 104.80 | 5 | |
| 13 | 107.94 | 5 1/2 | |
| 14 | 108.62 | 5 | |
| 15 | 111.16 | 5 1/2 | CL2 |
| 16 | 111.96 | 5 | |
| 17 | 114.14 | 5 | |
| 18 | 114.30 | 5 1/2 | |
| 19 | 115.82 | 5 | |
| 20 | 118.62 | 5 1/2 | |
| 21 | 121.36 | 5 1/2 | |
| 22 | 124.26 | 5 1/2 | |
| 23 | 125.74 | 5 1/2 | |
| 24 | 127.30 | 5 1/2 | |
| 25 | 133.36 | 7 | |
| 26 | 136.56 | 7 | CL3 |
| 27 | 139.70 | 7 | |
| 28 | 142.90 | 7 | |
| 29 | 144.16 | 6 5/8 | |
| 30 | 146.04 | 7 | |
| 31 | 147.10 | 6 5/8 | |
| 32 | 150.36 | 7 | |
| 33 | 150.40 | 6 5/8 | |
| 34 | 152.50 | 7 | |
| 35 | 153.64 | 6 5/8 | |
| 36 | 154.78 | 7 | |
| 37 | 157.08 | 7 | |
| 38 | 159.42 | 7 | |
| 39 | 161.70 | 7 | |
| 40 | 163.98 | 7 | |
| 41 | 166.06 | 7 | |

Figure 19

ANCHOR DEVICE

The present invention relates to an anchor device suitable for retaining a tool inside a tubular element such as a drill string, wellbore casing or other internal tubing, or an open wellbore.

It is known to use tools in a drilling system for drilling a wellbore for oil and/or gas production, or in the course of maintaining and optimizing production from an existing wellbore, to carry out various mechanical operations. It may also be required to use an anchor device to secure the tool in a tubular element such as a drill string, or wellbore casing, in order to operate the tool, and various configurations of anchor device are known.

Some anchor devices, such as that disclosed in WO2012/154686, utilise a plurality of locking dogs which are movable generally normal to the longitudinal axis of the tubular element between a retracted position to allow the anchor device to be lowered into the tubular element, and an extended position in which the locking dogs engage with a locking formation on the interior wall of the tubular element to prevent movement of the anchor device (and hence any attached tool) along the longitudinal axis of the tubular element. This configuration of anchor device relies on the tubing element having such locking formations, and there being an appropriately positioned locking formation, and so can only be used where the required position of the tool is predetermined.

Other anchor devices are known which do not engage with a locking formation on the tubular element, and therefore can be used to secure a tool in any configuration of tubular element at any position within the tubular element. For example, WO 2014/174288 and WO2009/037657 describe anchor devices of this sort. In the anchor device described in WO2009/037657, the anchoring tool comprises a plurality of friction pads each of which is mounted on a free end of an arm, the other end of the arm being pivotally connected to an actuator mounted on an anchor body. The free end of the arm engages with a wedge surface which is inclined relative to the anchor body. The actuator is operable to move the arm longitudinally relative to the anchor body, and when the actuator is operated to move the arm towards the wedge surface, the arm pivots, and the free end of the arm is pushed radially outwardly of the body so that the friction pad engages with the interior surface of the tubular element. It will be appreciated, however, that in this configuration, the radial distance the free end of the arm moves when engaged which the wedge surface is relatively limited, and this configuration of anchor cannot be used in tubular elements having a significant range of internal diameters.

It is an object of the present invention to provide an improved configuration of anchor device suitable for retaining a tool inside a tubular element.

According to a first aspect of the invention we provide an anchor device having a tubular body with a longitudinal axis, the tubular body being divided into a first body portion and a second body portion which are interconnected by means of a rigid connection so that movement between the first body portion and second body portion is substantially prevented, the anchor device further comprising an actuator having an actuation part which, by operation of the actuator, moves relative to the body, wherein the anchor device further comprises a first linkage set and second linkage set each of which includes at least one linkage, each linkage comprising a first, second and third link, the second link lying between the first and third links, and being pivotally connected to both, each linkage further comprising means to releasably pivotally connect the first link to the first body portion, and means to releasably pivotally connect the third link to the actuation part, the first and third links of each linkage in the first set being shorter than the first and third links of each linkage in the second set, and the second link of each linkage in the first set being longer than the second link of each linkage in the second set.

As such, the lengths of the links in each linkage can be set such that the total length of the linkage set when the links are extended so that the separation between the end of the first link which is adapted to be releasable connected to the first body portion, and the end of the third link which is adapted to be releasably connected to the actuation part is at its maximum, is substantially the same for the first linkage set and the second linkage set.

In a preferred embodiment, the second link of each linkage has an anchor face mounted thereon.

The anchor face may be provided with a plurality of striae which extend generally perpendicular to the longitudinal axis of the body.

The actuator is preferably configured such that movement of the actuation part relative to the body is translational movement.

In one embodiment, the actuator is operable to move the actuation part generally parallel to the longitudinal axis of the body in order to move the anchor face in a direction generally perpendicular to the longitudinal axis of the body.

The actuator may comprise a piston and cylinder, the cylinder being fixed to the second body portion and the piston being movable relative to the cylinder towards or away from the first body portion.

The first and third links of each linkage are preferably of generally equal length, so that when the linkage is connected between the first body portion and the actuation part, the second link is located generally centrally between the first body portion and the actuation part.

In one embodiment, the linkage is provided with a resilient biasing assembly such as a spring, which biases the links to a straight configuration in which the links are substantially aligned and are generally parallel to the longitudinal axis of the body when the linkage is connected between the first body portion and the actuation part. The anchor device is preferably configured such that when the actuation part is in a retracted position, and the separation of the first body portion from the actuation part is at a maximum, the linkage is in its straight configuration.

The rigid connection between the first body portion and the second body portion may comprise a rod which extends along the longitudinal axis of the body.

The anchor device may be provided with connections for a plurality of linkages which are spaced around the longitudinal axis of body. In one embodiment, the first and second set are each provided with three linkages.

At least one stop may be provided on either the movable actuation part or the first body portion, the stop being configured to engage with the other of the moveable actuation part or first body portion when the separation of the actuation part and the first body portion is at a desired minimum, to prevent any further movement of the actuation part towards the first body portion.

In one embodiment, the linkages are configured such that, when a linkage is connected between the first body portion and the actuation part, the pivot axis of the connection between the first link and the first body portion and the pivot axis of the connection between the third link and the actuation part are closer to the longitudinal axis of the body than the pivot axis of the connections between the second link and the first and third links.

In one embodiment, the anchor device is provided in a module with a one further anchor device. In this case, the second body portion of the first anchor device may provide the first body portion of the second anchor device.

According to a second aspect of the invention we provide an anchor device having a tubular body with a longitudinal axis, the tubular body being divided into a first body portion and a second body portion which are interconnected by means of a rigid connection so that movement between the first body portion and second body portion is substantially prevented, the anchor device further comprising at least one anchor face, and an actuator which is operable to move the anchor face towards or away from the longitudinal axis of the body, wherein, the actuator has an actuation part which, by operation of the actuator, moves relative to the body, and the anchor face is mounted on a linkage, a first end of which is pivotally connected to the first body portion, and a second end of which is pivotally connected to the movable actuation part.

The actuator may be configured such that movement of the actuation part relative to the body is translational movement.

The actuator may comprise a piston and cylinder, the cylinder being fixed to the second body portion and the piston being movable relative to the cylinder towards or away from the first body portion.

In one embodiment, the actuator is operable to move the actuation part generally parallel to the longitudinal axis of the body in order to move the anchor face in a direction generally perpendicular to the longitudinal axis of the body.

In one embodiment, the linkage comprises at least three links, a first link being pivotally connected to the first body portion, a third link being pivotally connected to the actuation part, and a second link, the second link lying between the other two links, and being pivotally connected to both.

The first link and the third link are preferably of generally equal length, so that the second link is located generally centrally between the first body portion and the actuation part.

The anchor face may be provided on the second link.

In one embodiment, the linkages are configured such that, the pivot axis of the connection between the first link and the first body portion and the pivot axis of the connection between the third link and the actuation part are closer to the longitudinal axis of the body than the pivot axes of the connections between the second link and the first and third links.

In one embodiment, the linkage is provided with a resilient biasing assembly such as a spring, which biases the links to a straight configuration in which the links are substantially aligned and are generally parallel to the longitudinal axis of the body. The anchor device is preferably configured such that when the actuation part is in a retracted position, and the separation of the first body portion from the actuation part is at a maximum, the linkage is in its straight configuration.

The rigid connection between the first body portion and the second body portion may comprise an elongate element such as a rod or tube which extends along the longitudinal axis of the body.

The anchor face may be provided with a plurality of striae or teeth which lie generally perpendicular to the longitudinal axis of the body.

The anchor device may be provided with a plurality of linkages, which are spaced around the longitudinal axis of body. In one embodiment, the anchor device is provided with three linkages which are spaced around the longitudinal axis of the body.

At least one stop may be provided on either the movable actuation part or the first body portion, the stop being configured to engage with the other of the moveable actuation part or first body portion when the separation of the actuation part and the first body portion is at a desired minimum, to prevent any further movement of the actuation part towards the first body portion.

In one embodiment, the anchor device is provided in a module with a further anchor device. In this case, the second body portion of the first anchor device may provide the first body portion of the second anchor device.

According to a third aspect of the invention we provide an anchor device having a body with a longitudinal axis, at least one anchor face, and an actuator which is operable to move in a first direction which causes the anchor face to move away from the longitudinal axis of the body, wherein the linkage comprises at least two link assemblies, a first link assembly being pivotally connected to the body, a second link assembly being pivotally connected to the actuator, and a wedge part, the wedge part lying between and being connected to the two link assemblies, wherein the anchor device is configured such that movement of the actuator in the first direction causes the link assemblies to move in two stages, a first stage in which there is no pivotal movement of the link assemblies, and a second stage in which the link assemblies pivot about their connection to the body and the actuator respectively, the first and second stage movement of the link assemblies causing the wedge part to move away from the longitudinal axis of the body.

In one embodiment, the actuator is operable to move generally parallel to the longitudinal axis of the body to move the anchor face in a direction generally perpendicular to the longitudinal axis of the body.

In one embodiment, the wedge part is provided with two cam surfaces which are each inclined relative to the longitudinal axis of the body, and each of the link assemblies engages with one of these cam surfaces, and slides along the respective cam surface during the first stage.

Each link assembly may comprise pivotally connected first and second links, a first link of the first link assembly being pivotally connected to the body, and a second link of the second link assembly being connected to the wedge part, and a first link of the second assembly being pivotally connected to the actuator, and a second link of the second link assembly being connected to the wedge part.

In one embodiment, the linkage is provided with a resilient biasing assembly, which biases the link assemblies to a straight configuration in which the link assemblies are substantially aligned and are generally parallel to the longitudinal axis of the body.

In one embodiment, the body is divided into a first and second body portion which are connected by a rigid connection so that movement of the first body portion relative to the second body portion is substantially prevented.

The rigid connection between the first body portion and the second body portion may comprise a rod which extends along the longitudinal axis of the body.

The actuator may be mounted on the second body portion, and the first link assembly pivotally connected to the first body portion.

In one embodiment, the actuator comprises a piston and cylinder, the cylinder being fixed to the second body portion and the piston being movable relative to the cylinder towards or away from the first body portion, the first linkage assembly being pivotally connected to the first body portion, and the second linkage assembly being pivotally connected to the piston. In this case, the anchor device is preferably configured such that when the piston is in a retracted position, and the separation of the first body portion from the piston is at a maximum, the linkage assemblies are in their straight configuration.

The anchor face may be provided on the wedge part.

The first link assembly and second link assembly are preferably of generally equal length, so that the wedge part is located generally centrally between the body and the actuator.

The anchor face may be provided with a plurality of striae which extend generally perpendicular to the longitudinal axis of the body.

The anchor device may be provided with a plurality of linkages, which are spaced around the longitudinal axis of body. In one embodiment, the anchor device is provided with three linkages which are spaced around the longitudinal axis of the body.

At least one stop may be provided on either the movable actuation part or the first body portion, the stop being configured to engage with the other of the moveable actuation part or first body portion when the separation of the actuation part and the first body portion is at a desired minimum, to prevent any further movement of the actuation part towards the first body portion.

In one embodiment, the anchor device is provided in a module with a one further anchor device, the second body portion of the first anchor device providing the first body portion of the second anchor device.

Figure 2:
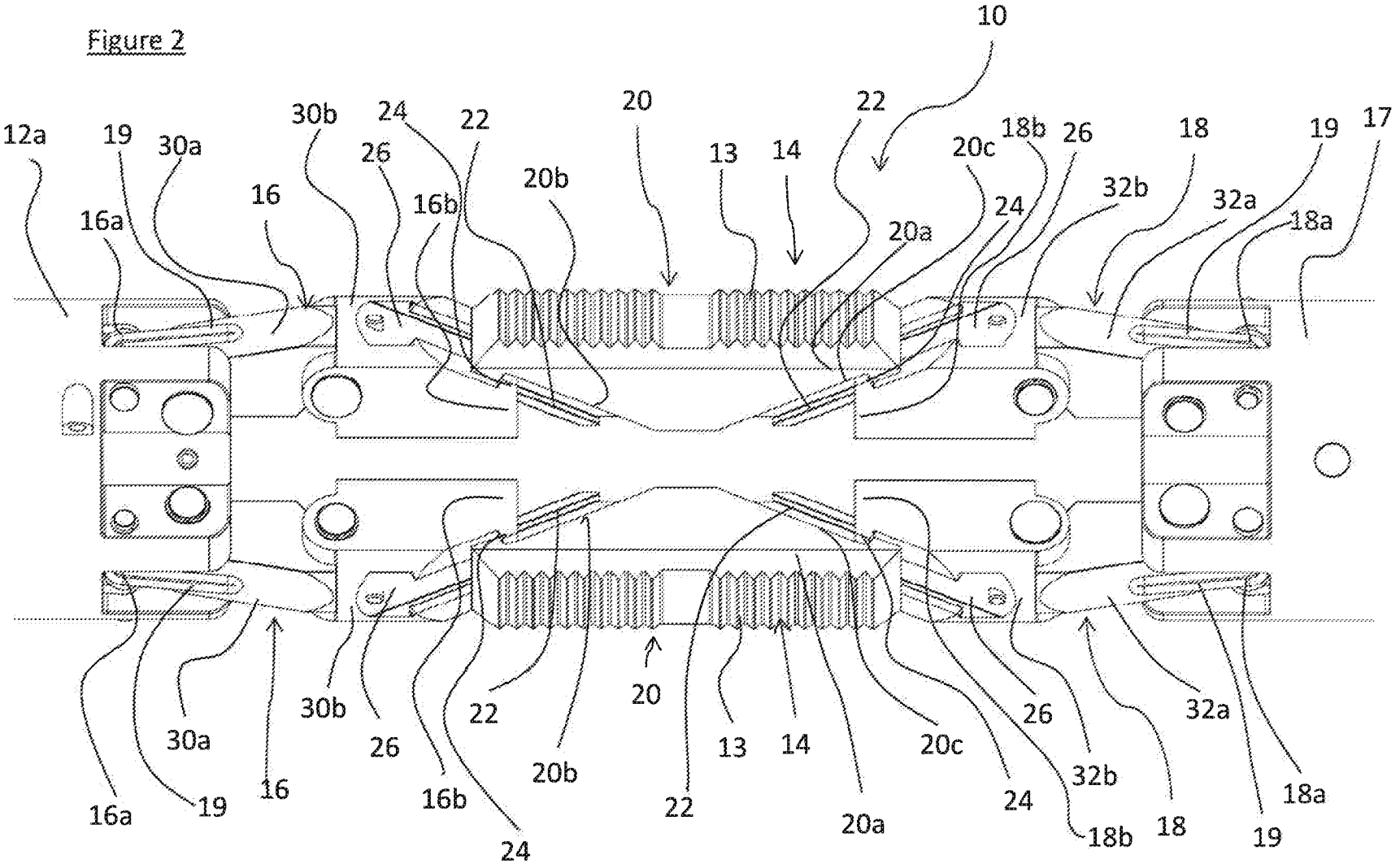
Figure 3A:
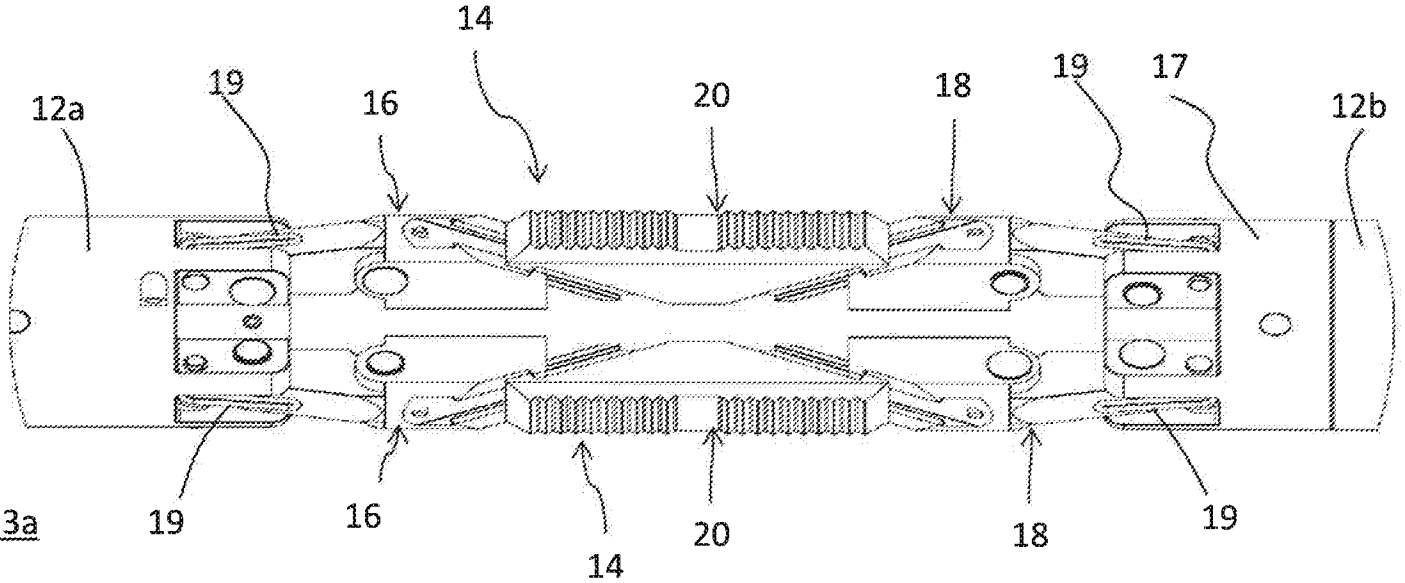
Figure 3B:
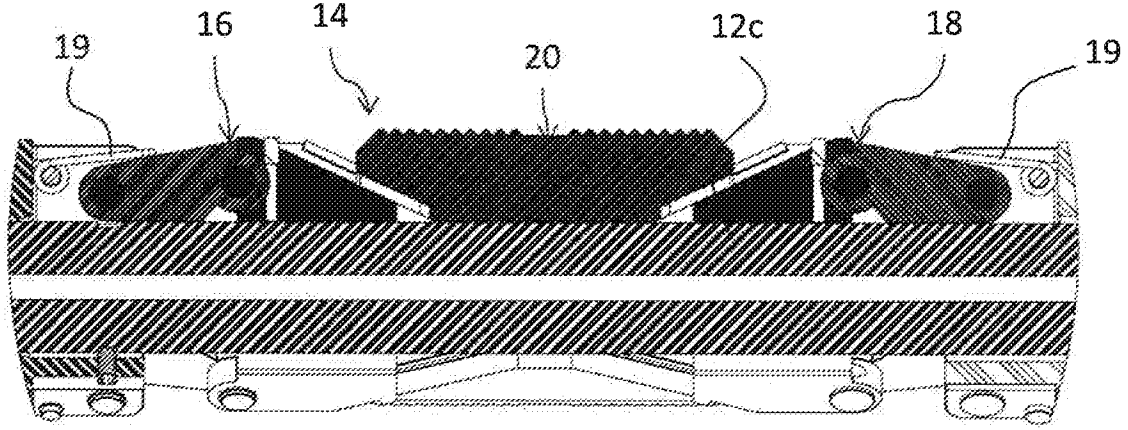
Figure 4:
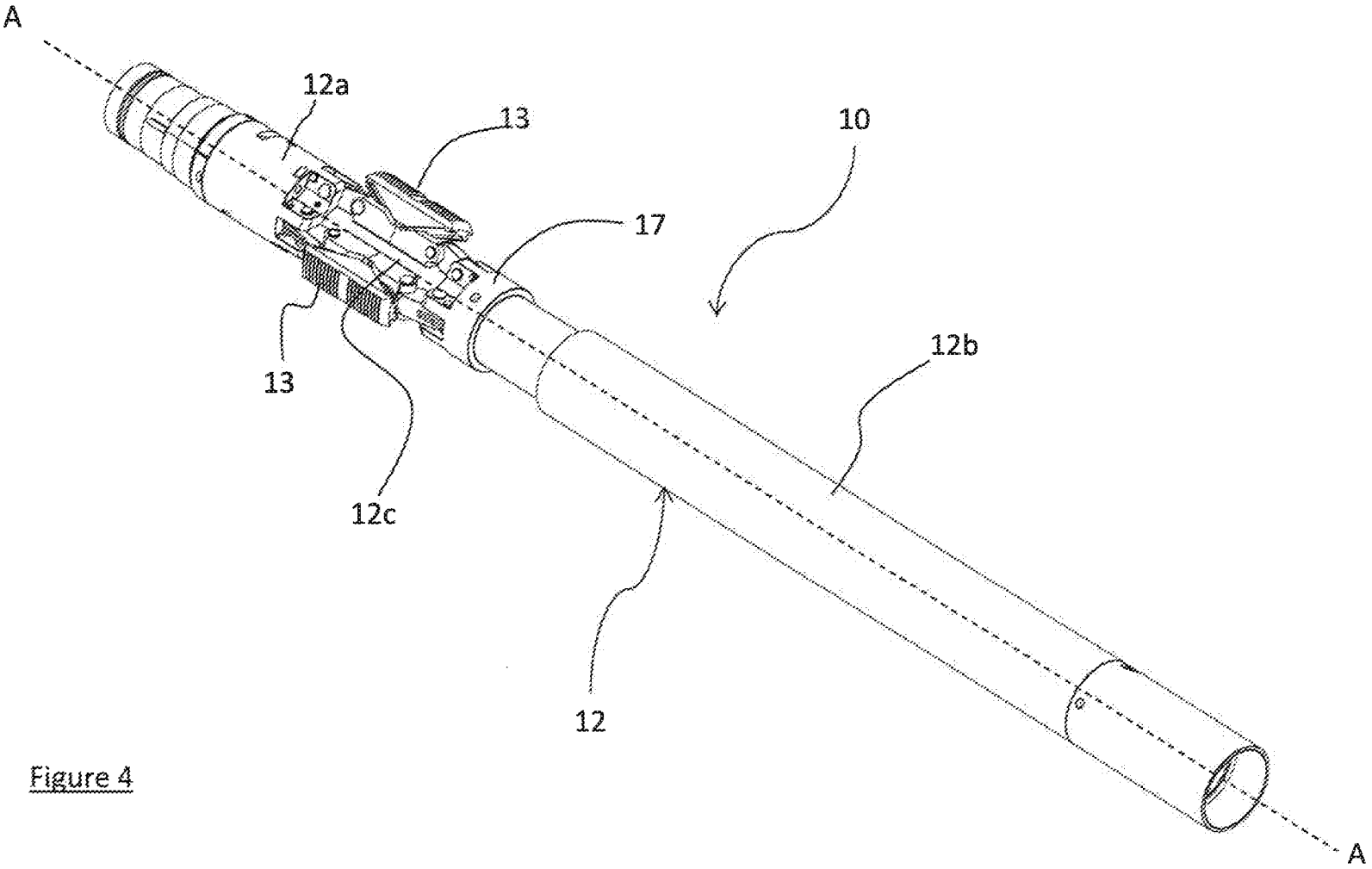
Figure 5A:
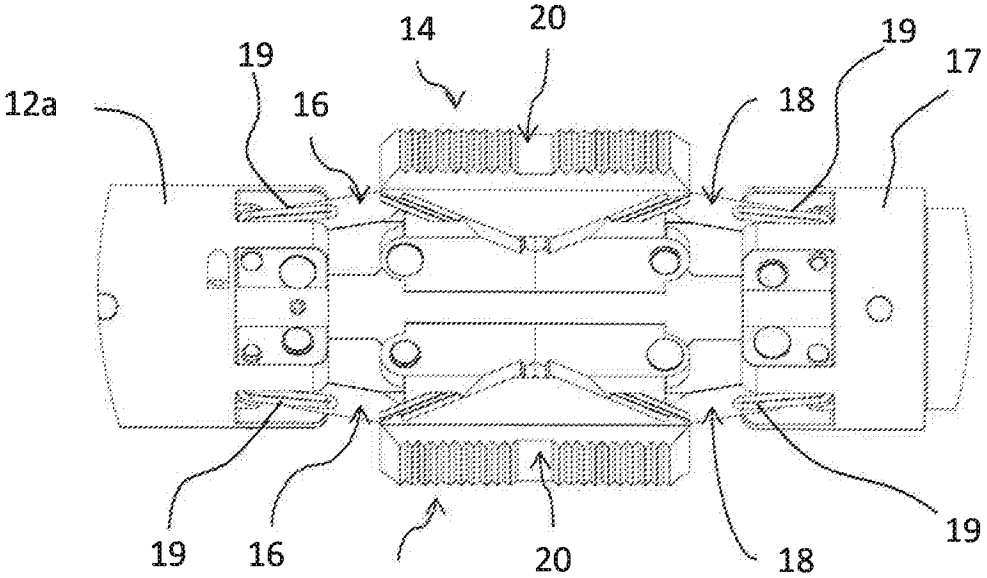
Figure 5B:
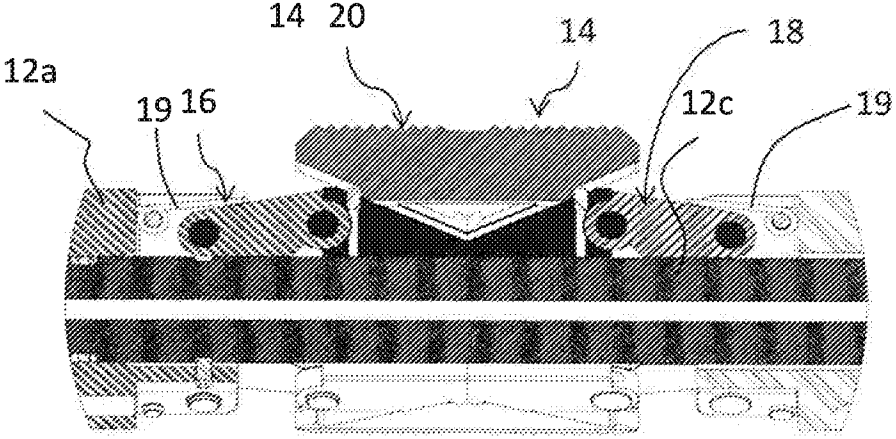
Figure 6:
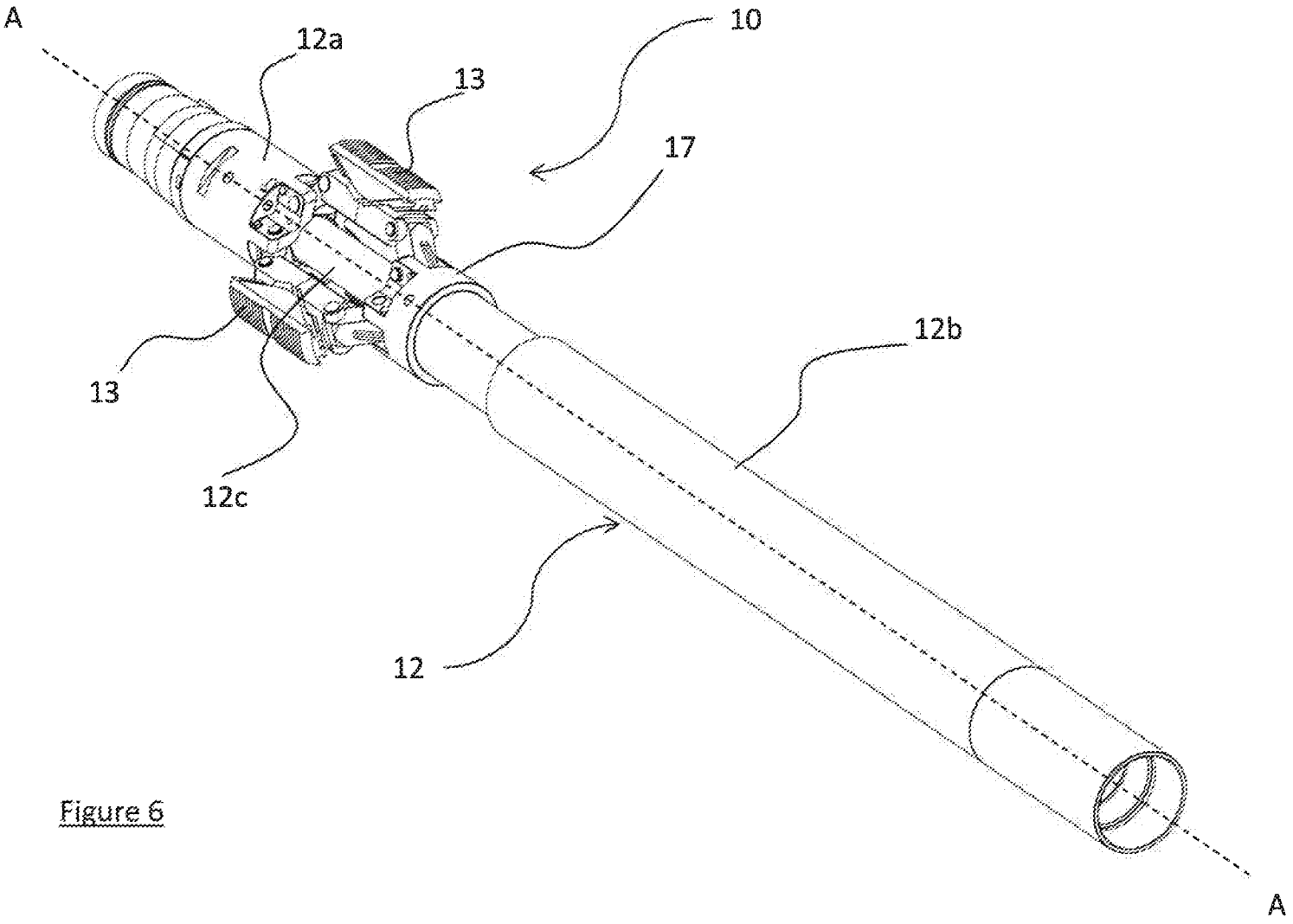
Figure 7A:
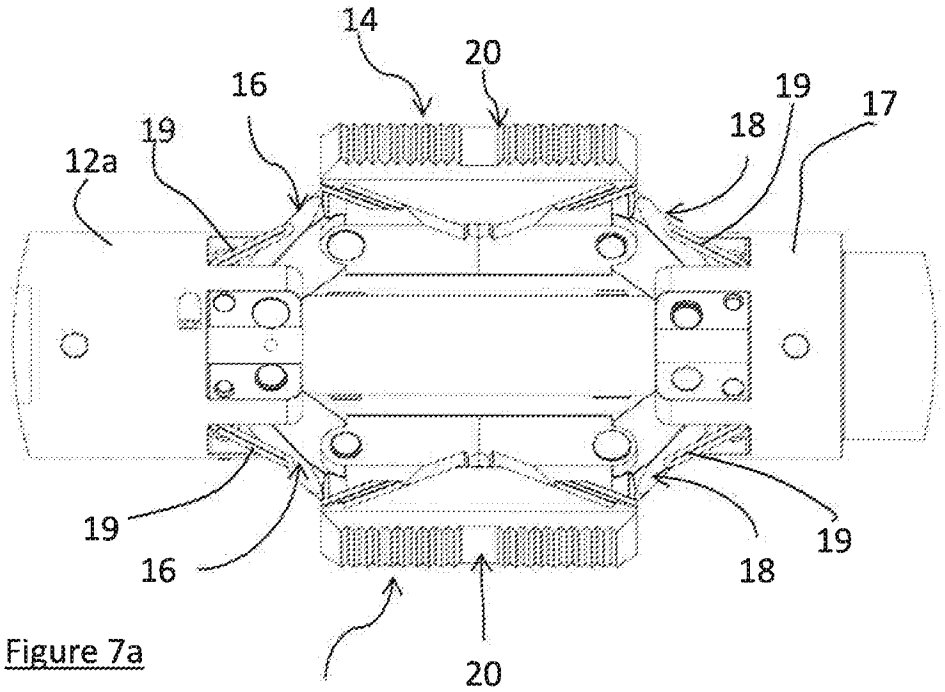
Figure 7B:
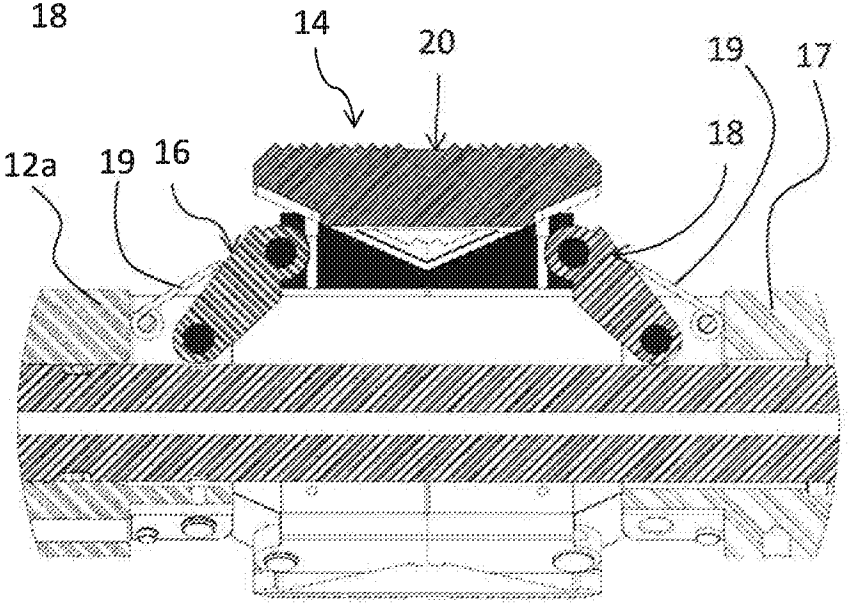
Figure 8:
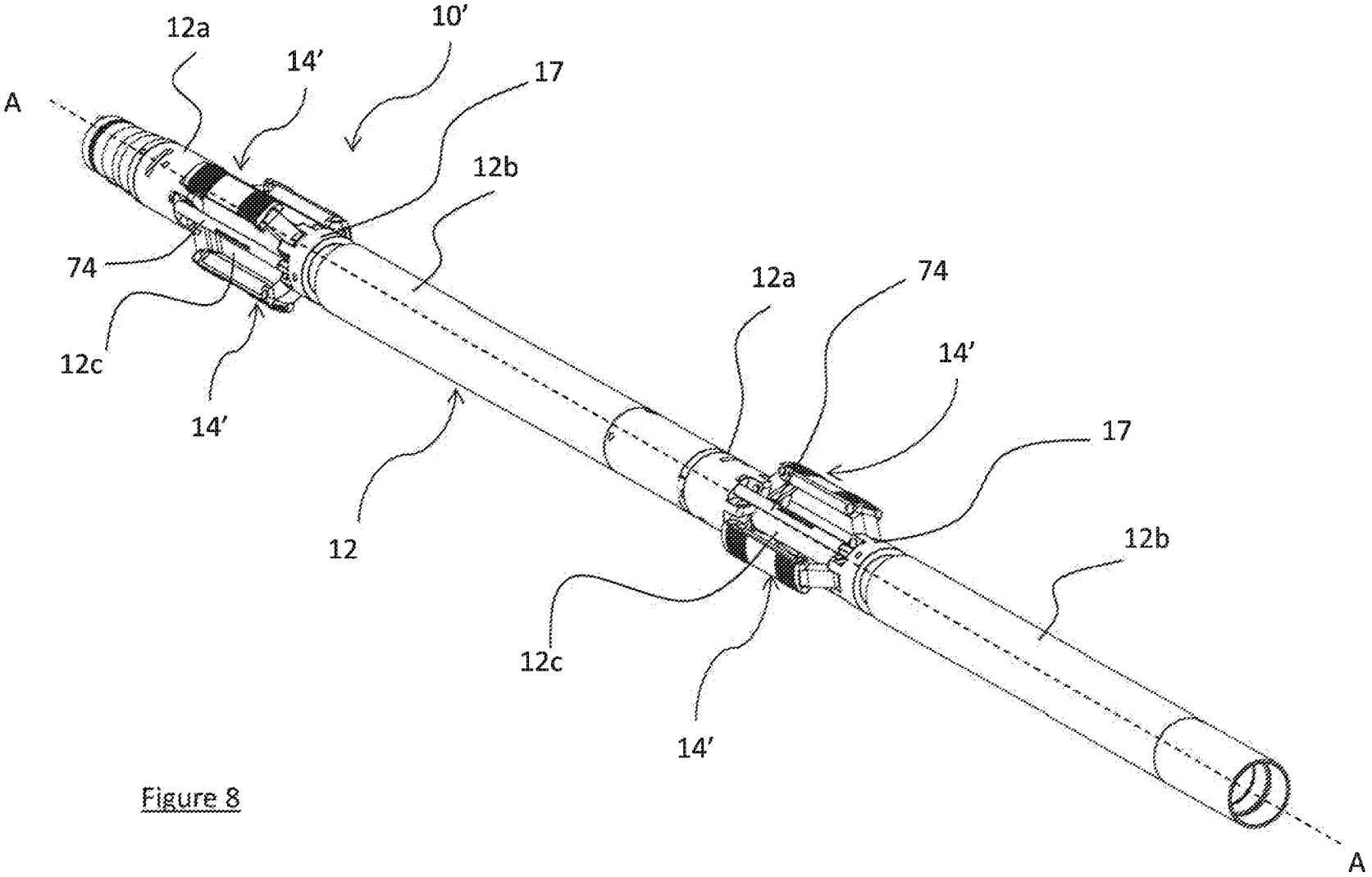
Figure 9:
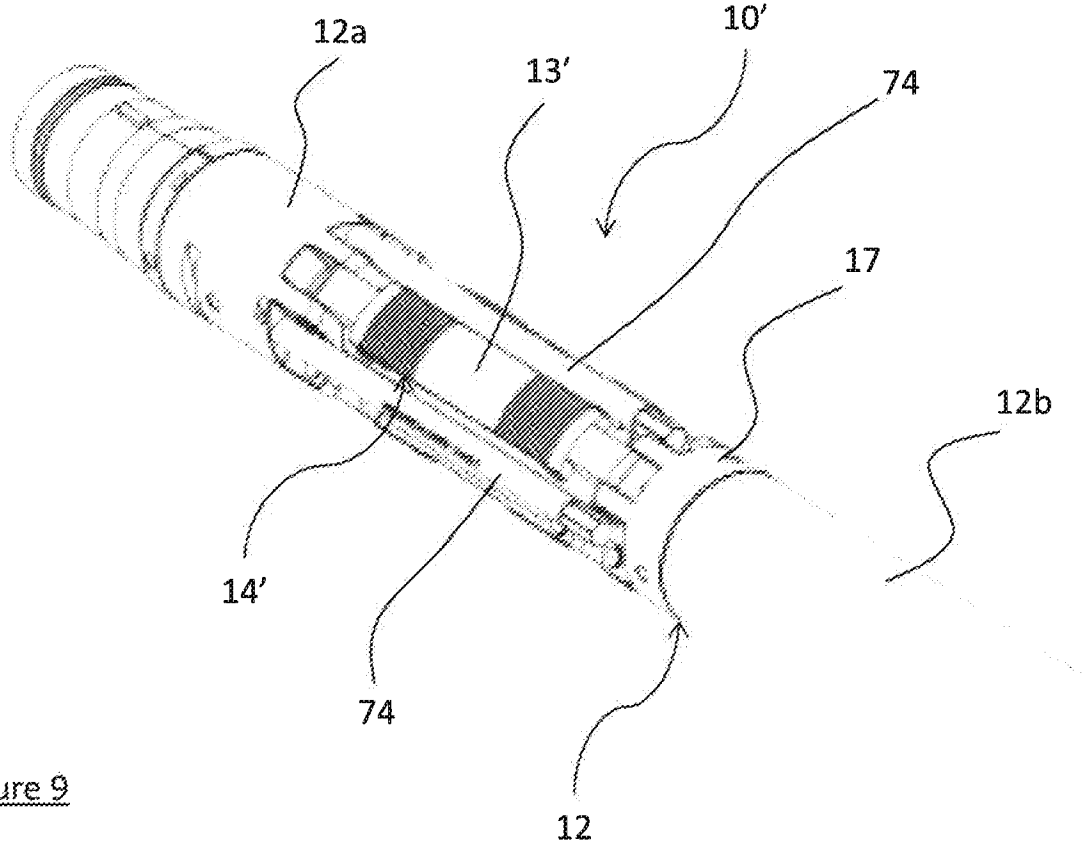
Figure 10A:
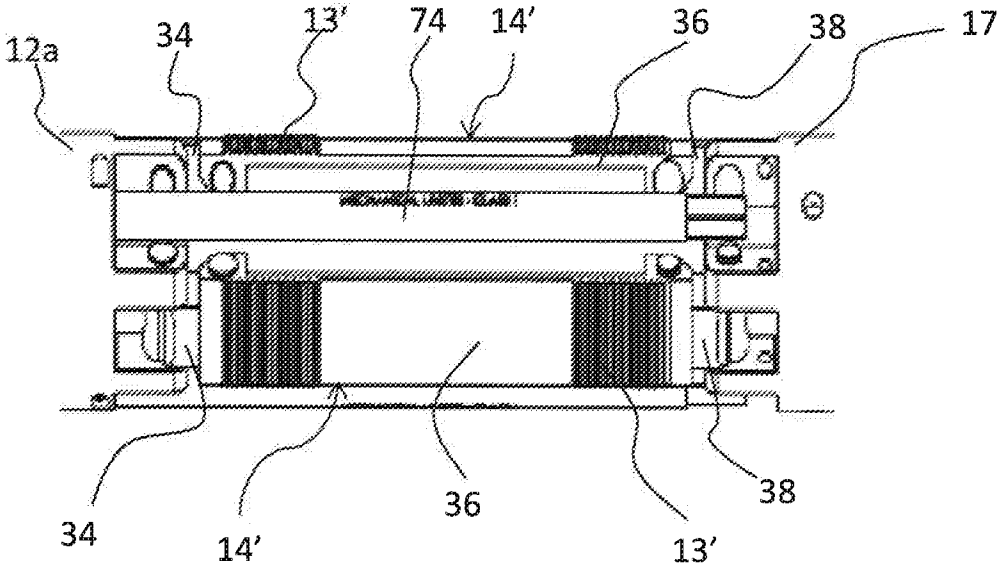
Figure 10B:
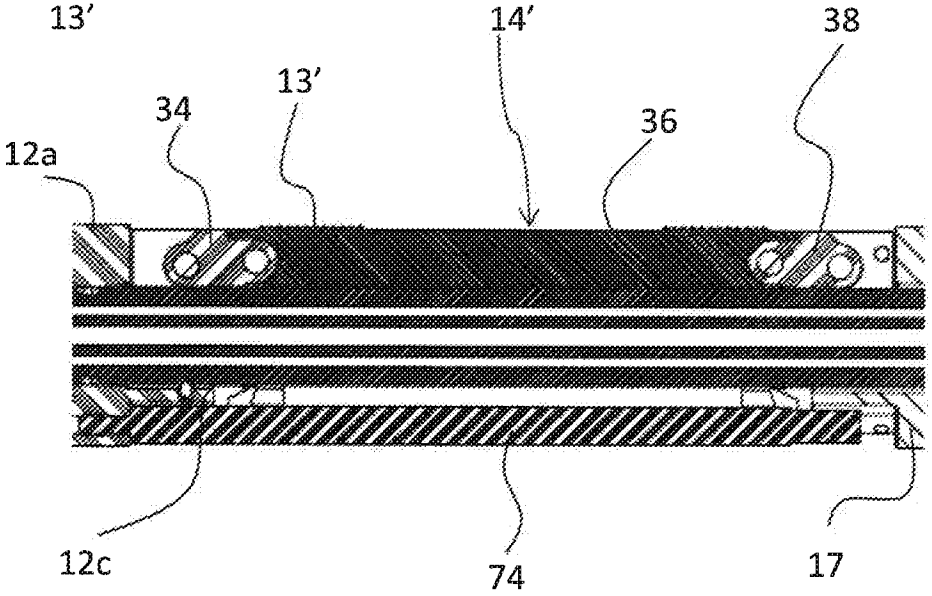
Figure 11:
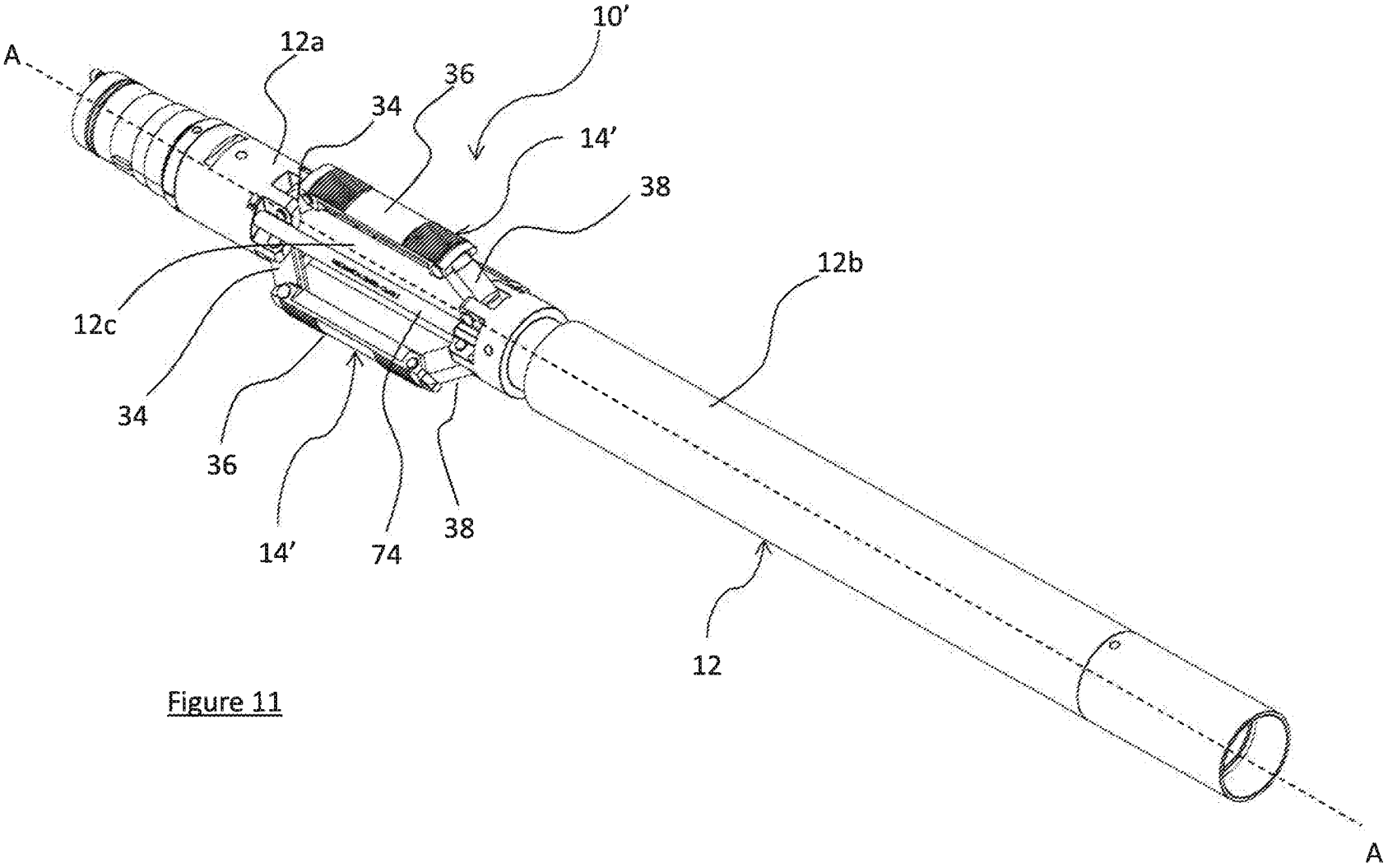
Figure 12A:
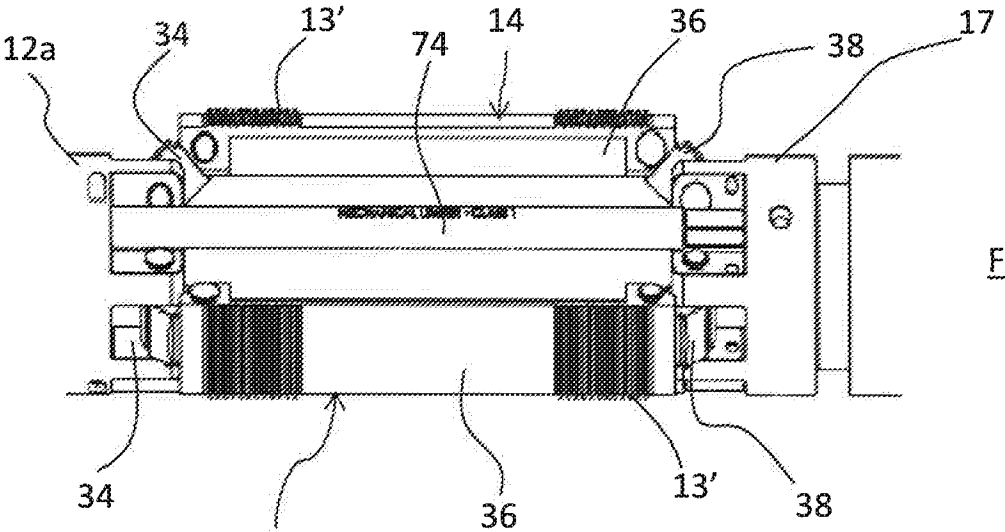
Figure 12B:
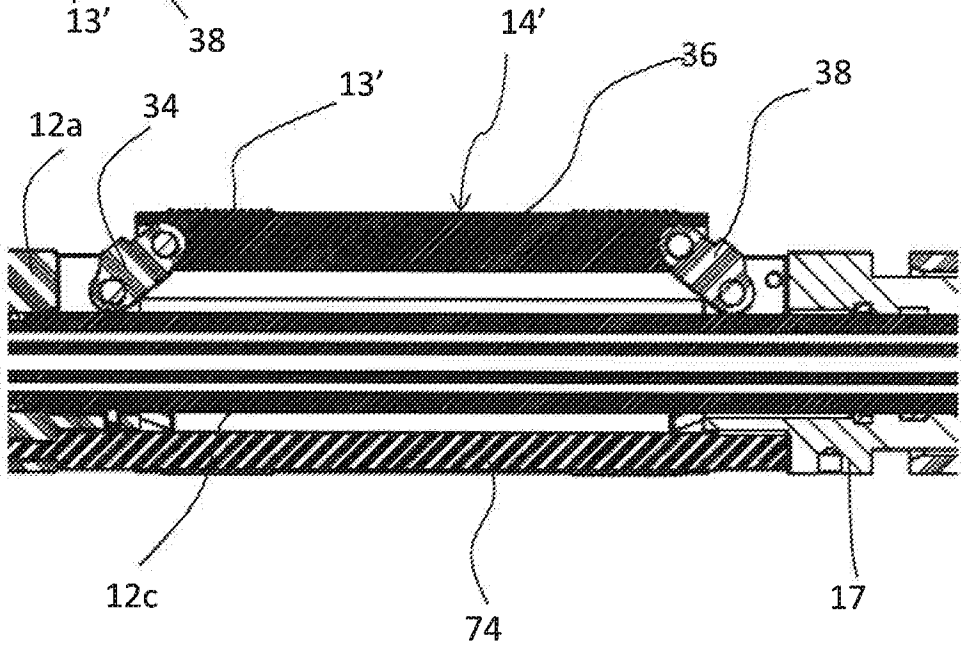
Figure 13:
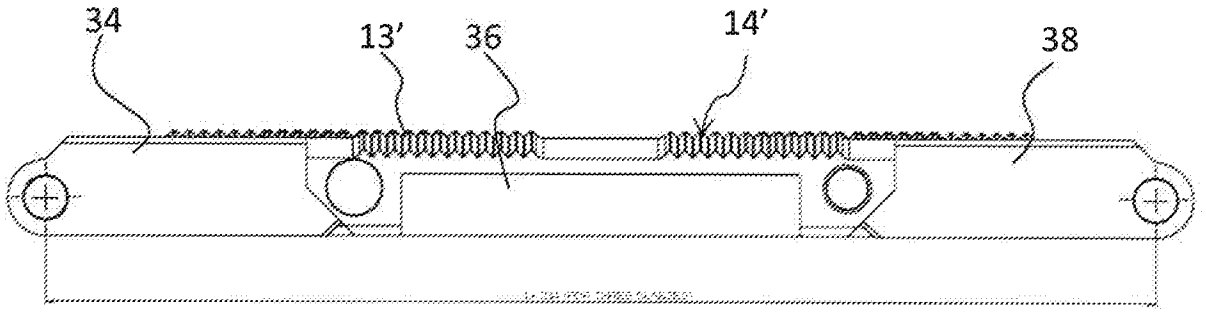
Figure 14:
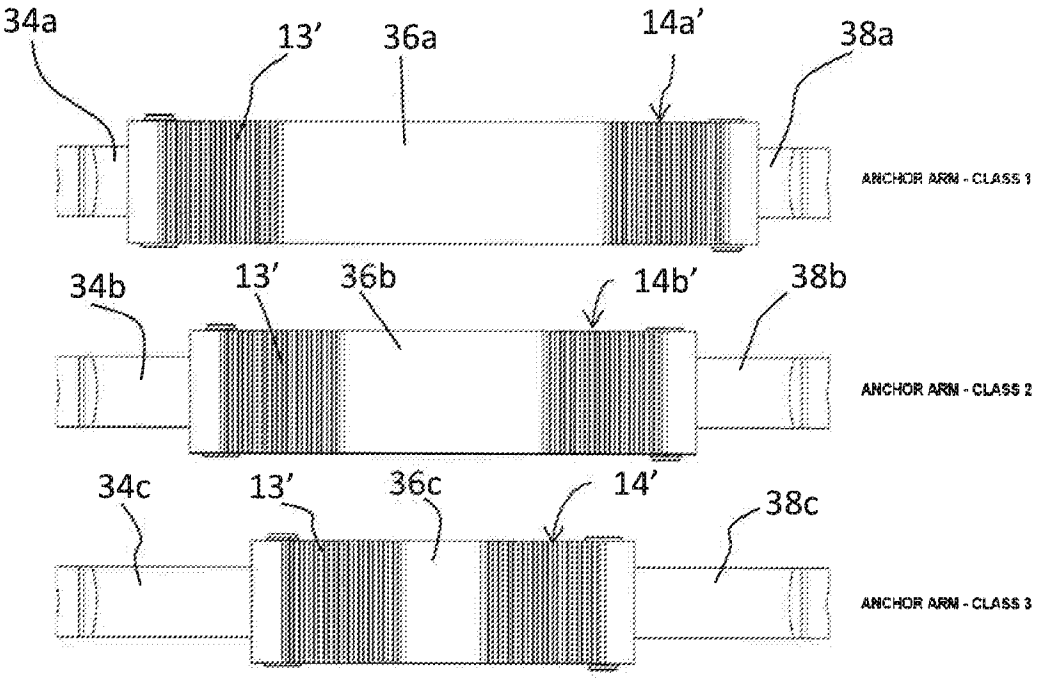
Figure 15B:
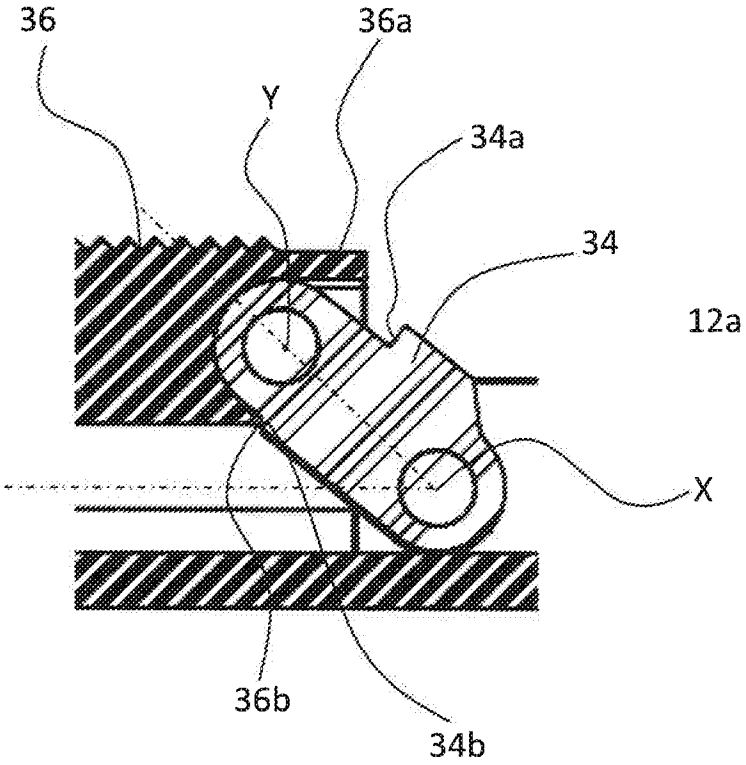
Figure 15A:
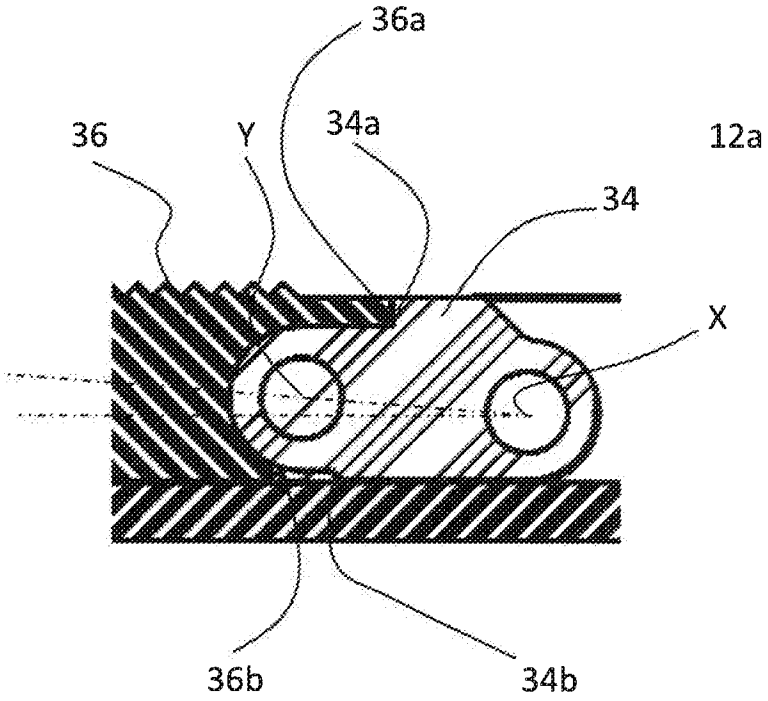
Figure 16:
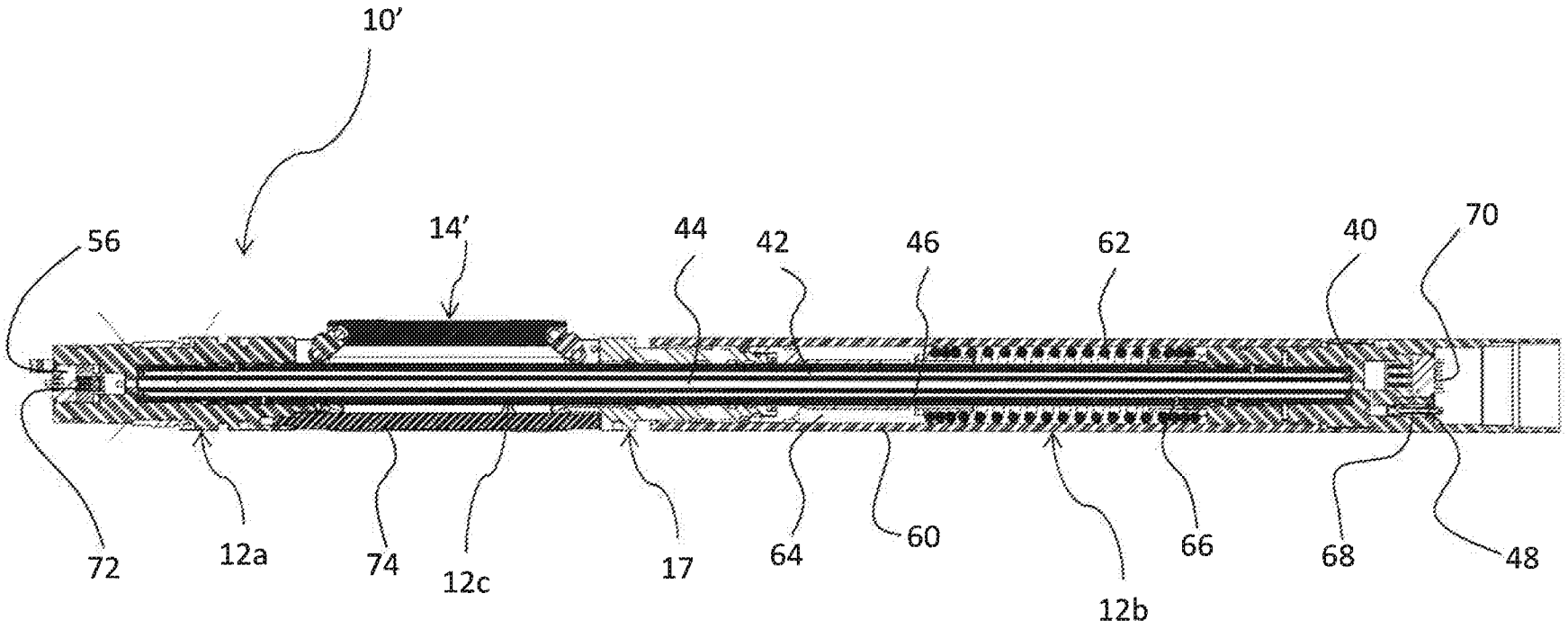
Figure 17:
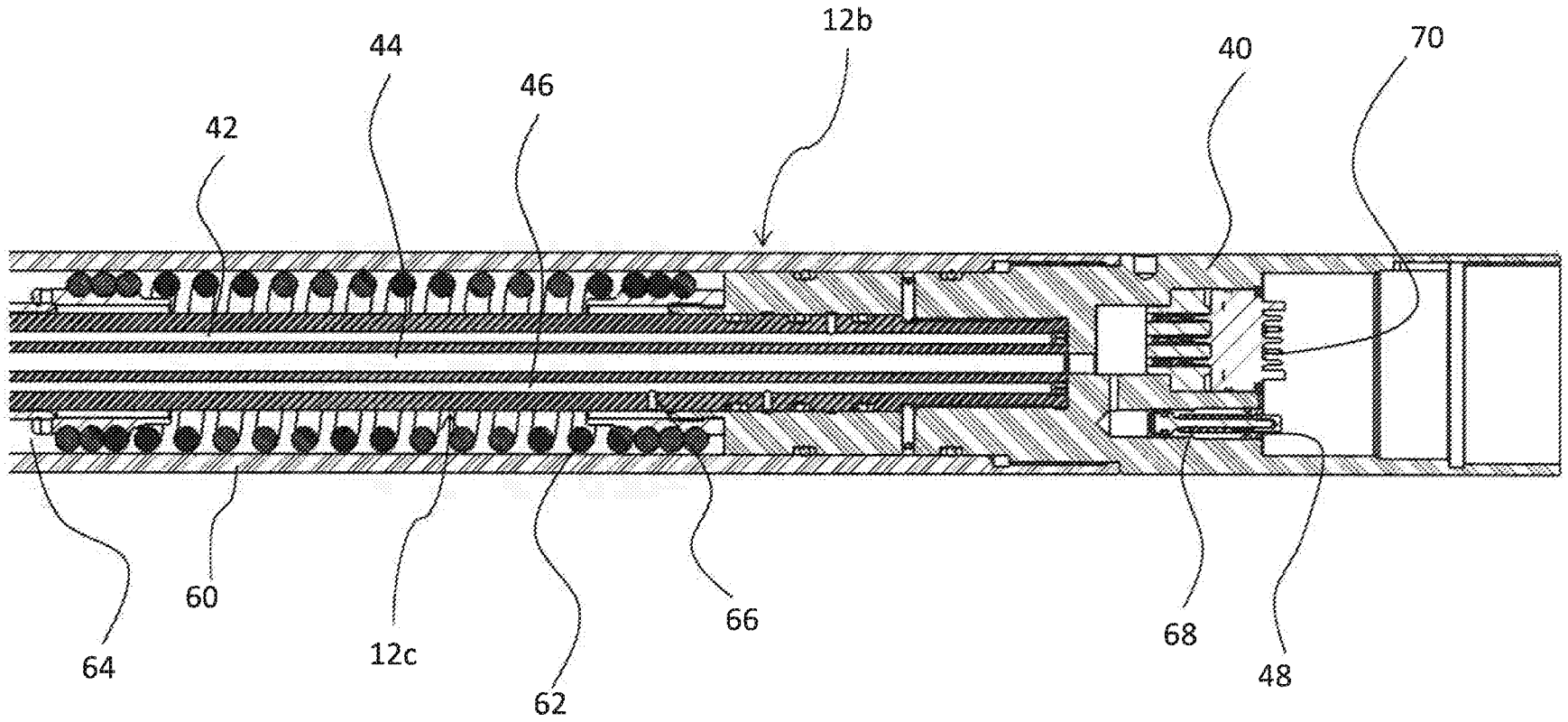
Figure 18:
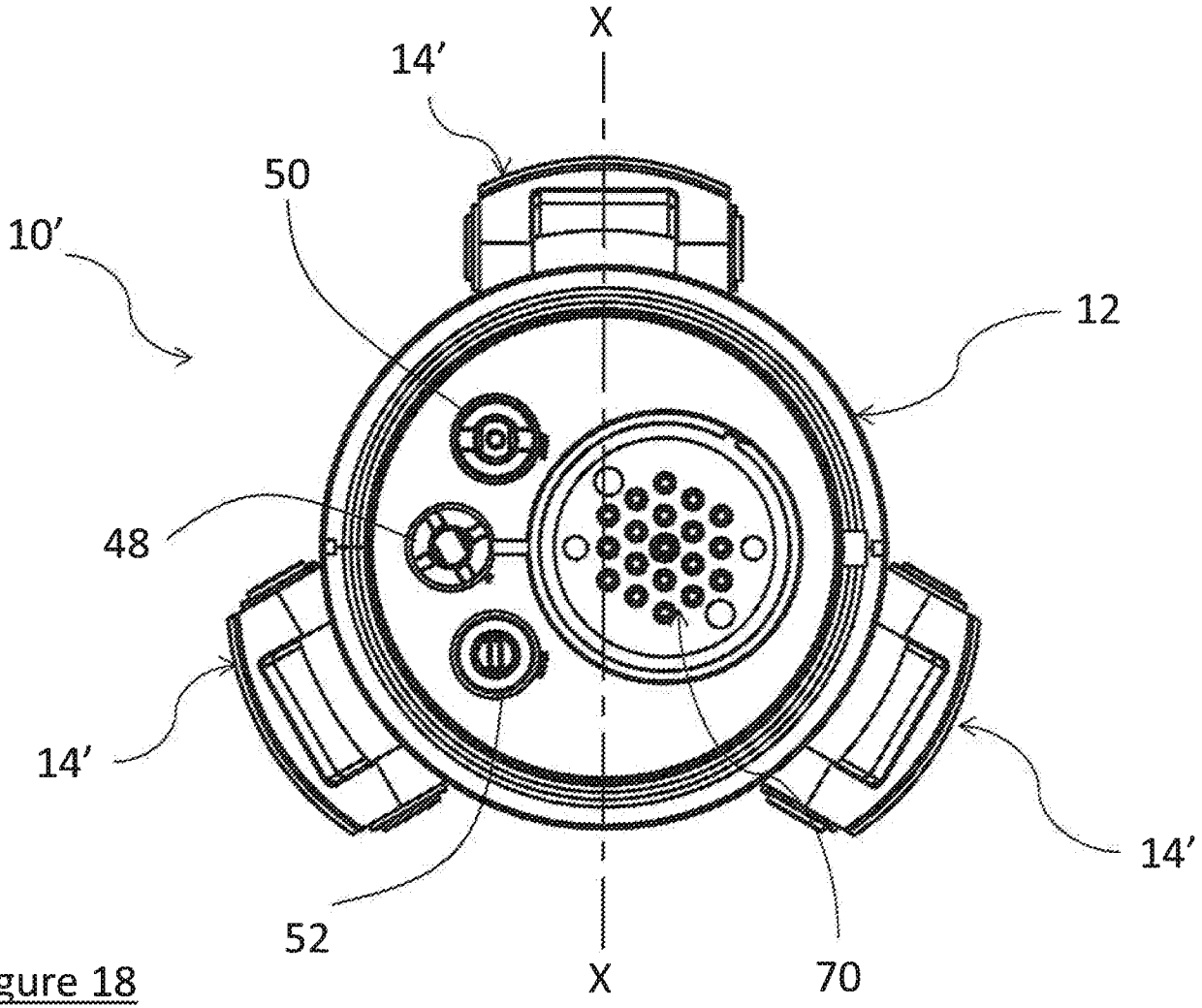

Embodiments of the invention will now be described, by way of example only, with reference to the accompanying figures of which:

FIG. 1 is a perspective view of a module including one anchor device according to the first and second aspects of the invention, FIG. 2 is a side view of the anchor device of the module illustrated in FIG. 1, FIG. 3 shows the linkages of the anchor device illustrated in FIG. 1 with the actuator in the retracted position, a) as a side view, and b) in longitudinal cross-section, FIG. 4 is a perspective view of the anchor device illustrated in FIG. 1, with the actuator at the end of stage 1 movement, FIG. 5 shows the linkages of the anchor device illustrated in FIG. 1, with the actuator at the end of its stage 1 movement, a) as a side view, and b) in longitudinal cross-section, FIG. 6 is a perspective view of the anchor device illustrated in FIG. 1, with the actuator at the end of its stage 2 movement, FIG. 7 shows the linkages of the anchor device illustrated in FIG. 2, with the actuator at the end of its stage 2 movement, a) as a side view, and b) in longitudinal cross-section, FIG. 8 shows a perspective view of a module including two alternative embodiments of anchor device according to the first and third aspects of the invention, FIG. 9 is a perspective illustration of one of the anchor devices illustrated in FIG. 8, with the actuator in its retracted position, FIG. 10 shows the linkages of the anchor device illustrated in FIG. 9 with the actuator in its retracted position, a) in side view, and b) in longitudinal cross-section, FIG. 11 is a perspective illustration of one of the anchor devices illustrated in FIG. 8, with the actuator in its fully extended position, FIG. 12 shows the linkages of the anchor device illustrated in FIG. 8 with the actuator in its fully extended position, a) in side view, and b) in longitudinal cross-section, FIG. 13 shows a side view of one of the linkages of the anchor device illustrated in FIG. 8, FIG. 14 shows a top view of a set of three linkages suitable for use in the anchor devices illustrated in FIG. 8, FIG. 15 is a side view of the detail of the connection between the first link and the first body portion and second link of one of the linkages of one of the anchor devices illustrated in FIG. 8 a) when the actuator is in the retracted position, and b) when the actuator is in its fully extended position, FIG. 16 illustrates a longitudinal cross-section through the embodiment of anchor device illustrated in FIG. 8, FIG. 17 shows an enlarged portion of the cross-section illustrated in FIG. 16, FIG. 18 shows an end view of the anchor device illustrated in FIG. 16, and FIG. 19 shows a table of full range of tubes between 4½" and 7" listed in the API Specification 5CT/ISO 11960 Standard, and their corresponding linkage class.

Referring now to FIG. 1, there is shown a module including a first embodiment of anchor device 10 according to the first and second aspects of the invention. The anchor device 10 is adapted to be placed in the interior of a tubular element such as a drill string of wellbore casing, and operated to engage with the interior surface of the tubular element so that movement of the anchor device (and therefore any tool secured to the anchor device) relative to the tubular element is restricted or substantially prevented.

The anchor device 10 has an elongate body 12 which has a longitudinal axis A. When in use in the interior of a tubular element, the longitudinal axis A of the elongate body 12 is typically arranged so that it is parallel to or coincident with the longitudinal axis of the tubular element. The anchor device 10 further includes an actuator which is operable to move at least one anchor face 13 towards or away from the longitudinal axis A of the body. In this example, the actuator is operable to move generally parallel to the longitudinal axis A of the elongate body 12 to push a plurality of anchor faces 13 in a direction generally perpendicular to the longitudinal axis of the elongate body 12 so that the anchor faces 13 engage with the interior surface of the tubular element.

The elongate body 12 is divided into a first body portion 12*a* and a second body portion 12*b*, which are connected by rigid connection such that movement of the first body portion 12*a* relative to the second body portion 12*b* is substantially prevented. In this embodiment, the rigid connection comprises a rod 12*c* which extends along the longitudinal axis A of the body 12.

In this embodiment, the actuator comprises a hydraulically operated piston 17 which is mounted in a cylinder, and the cylinder forms part of the second body portion 12*b*. The piston 17 extends from an end of the second body portion 12*b* adjacent to the first body portion 12*a*, and supply of hydraulic fluid to the cylinder pushes the piston 17 out of the cylinder, so the piston 17 is pushed towards the first body portion 12*a*. The configuration of the piston 17 and cylinder will be described in more detail below.

The piston 17 is connected to the first body portion 12*a* by means of a plurality of linkages 14, as is illustrated in FIG. 2. Each linkage 14 comprises two substantially identical link assemblies 16, 18 and a wedge part 20, a first end 16*a* of the first one 16 of the link assemblies being pivotally connected to an end of the first body portion 12*a* and a first end 18*a* of the second one 18 of the link assemblies being pivotally connected to the piston 17. A second end 16*b*, 18*b* of each of the link assemblies 16, 18 is connected to the wedge part 20, so that the first body portion 12*a* and piston 17 are connected via the two link assemblies 16, 18 and the wedge part 20.

The wedge part 20 is generally triangular. It has an outermost face 20*a* which extends generally parallel to the longitudinal axis A of the elongate body and faces radially outwardly thereof, on which is provided one of the anchor faces 13. Each anchor face 13 is provided with a high-friction surface, which could comprise a roughened surface, a plurality of teeth, ridges or striae. It will be appreciated that the provision of such a high-friction surface will assist the anchor device in gripping to the interior surface of the tubular element.

The two other faces of the wedge part 20 are both inclined at an angle of around 30° to the outermost face 20*a* and will hereinafter referred to as the first and second inclined faces 20*b*, 20*c* respectively. The outermost face 20*b* and first and second inclined faces 20*b*, 20*c* thus form an isosceles triangle.

As illustrated in detailed in FIG. 2, the first inclined face 20*b* engages with the second end 16*b* of the first link assembly 16, and provides a slide formation 22 in or on which a runner 24 provided on the second end 16*b* of the first link assembly 16 is held captive. The engagement of the slide formation 22 and the runner 24 prevents the separation of the first link assembly 16 from the wedge part 20, but the runner 24 is free to slide along the slide formation 22 along substantially the entire length of the first inclined face 20*b*.

The second end 18*b* of the second link assembly 18 is connected to the second inclined face 20*c* of the wedge part 20 in exactly the same way.

As best illustrated in FIG. 2, the second end 16*b*, 18*b* of each link assembly 16, 18 is provided with a bearing face 26 which is inclined relative to a longitudinal axis of the link assembly 16, 18 at the same or a very similar angle to the angle of inclination of the inclined surfaces 20*b*, 20*c* relative to the outermost surface 20*a* of the wedge part 20. Each bearing face 26 is substantially parallel to the corresponding inclined face 20*b*, 20*c* of the wedge part 20, and is designed to butt up against and slide along the corresponding inclined face 20*b*, 20*c* of the wedge part 20.

In this particular embodiment, the slide formation 22 comprises two lips which extend from the two opposite long edges of the inclined face 20*b*, 20*c*, outwardly from the wedge part 20 and generally parallel to the inclined face 20*b*, 20*c*. The runner 24 comprises a pair of opposing pins which each extend inwardly from one of a pair of generally parallel support arms. The support arms extend from the second end 16*b*, 18*b* of the link assembly 16, 18, with the bearing face 26 lying therebetween. When the bearing face 26 is engaged with the corresponding inclined surface 20*b*, 20*c* of the wedge part 20, the support arms extend past the lips, and each of the lips 22 lies between one of the pins 24 and the bearing face 26. The pins 24 therefore engage with the lips 22 to prevent the link assembly 16, 18 from being separated from the wedge part 20.

In this embodiment, each of the link assemblies 16, 18 comprises pivotally connected first and second links 30*a*, 30*b*, 32*a*, 32*b*. Of the first link assembly 16, the first end 16*a* thereof is provided on first link 30*a*, and the second end 16*b* on second link 30*b*. Of the second link assembly 18, the first end 18*a* thereof is provided on first link 32*a*, and the second end 18*b* on second link 32*b*.

In this embodiment, the anchor device 10 is provided with three linkages 14, which are regularly spaced around the elongate body 12. It will be appreciated, however, that this need not be the case, and fewer or more linkages may be used.

In the embodiment illustrated in FIG. 1, the module is provided with only one anchor device 10. In an alternative embodiment of the invention, the anchor device 10 is provided in a module with a one further anchor device 10, the second body portion 12*b* of the first anchor device 10 providing the first body portion 12*a* of the second anchor device. It will be appreciated, of course, that, in the same way, more than two anchor devices 10 may be provided in a module.

The link assemblies 16, 18 are provided with a resilient biasing assembly such as a torsion spring 19, which biases the link assemblies 16, 18 to a straight configuration in which the first link 30*a*, 32*a* is substantially aligned with the second link 30*b*, 32*b*, and both are generally parallel to the longitudinal axis of the elongate body 12. When the piston 17 is in a retracted position, the separation of the first body portion 12*a* from the piston 17 is at a maximum, the link assemblies 16, 18 are in their straight configuration, and the runners 24 are at the end of the inclined faces 20*b*, 20*c* adjacent to the outermost face 20*a* of the wedge part 20. This is illustrated in FIGS. 1, 2, and 3*a*, and 3*b*.

When pressurised fluid is supplied to the cylinder, the piston 17 moves from its retracted position towards the first body portion 12*a*, the resilient biasing assembly maintains the link assemblies 16, 18 in their straight configuration, and the initial movement of the piston 17 towards the first body portion 12*a* pushes the link assemblies 16, 18 towards one another which causes the bearing face 26 provided at the second ends 16*b*, 18*b* of the link assemblies 16, 18 to push against the inclined faces 20*b*, 20*c* of the wedge part 20. As a result, the wedge part 20 slides along the bearing face 26 and the runners 24 move towards one another along the lip formation 22, thus pushing the wedge part 20 radially outwardly, i.e. in a direction perpendicular to the longitudinal axis of the elongate body 12. This process represents a first stage (wedging movement) in the movement of the anchor face 13 towards the interior surface of a tubular element in which the anchor device 10 is located.

As a result of this movement, each anchor face 13 provided on the outermost face 20*a* of the wedge parts 20 may come into engagement with the interior surface of the tubular element in which the anchor device 10 is located, so that the wedge parts 20 lock the anchor device 10 in the tubular element. The force with which the wedge parts 20 are pushed against the tubular element, and hence the force required to dislodge the anchor device 10 and move it along the tubular element can be increased by increasing the pressure of the hydraulic fluid supplied to the cylinder.

If, however, the internal diameter of the tubular element is larger, the outermost face 20*a* of the wedge part 20 may not come into contact with the interior surface of the tubular element, before the second end 16*a* of the first link assembly 16 comes into engagement with the second end 18*b* of the second link assembly 18. At this point, the runners 24 cannot move any further along the lip formations 22, and so the wedge part 20 is at its maximum extension relative to the second ends 16*b*, 18*b* of the link assemblies 16, 18. This is illustrated in FIGS. 4, 5*a* & 5*b*.

Further supply of hydraulic fluid to the cylinder will overcome the biasing force of the resilient biasing elements 19 enabling the link assemblies 16, 18 to move from their straight configuration. The first end 16*a*, 18*a* of each of the link assemblies 16, 18 pivots about its connection to the elongate body 12, so that the second end 16*b*, 18*b* of each of the link assemblies 16, 18 moves radially outwardly relative to the longitudinal axis A of the elongate body 12. As a result, the radially outward movement of the wedge part 20 continues until it engages with the interior surface of the tubular element in which the anchor device 10 is located. This is illustrated in FIGS. 6, 7*a* & 7*b*, and is a second stage in the movement of the anchor faces 13 towards the interior surface of a tubular element in which the anchor device 12 is located. As before, the force with which the anchor faces 13 are pushed against the tubular element, and hence the force required to dislodge the anchor device 10 and move it along the tubular element can be increased by increasing the pressure of the hydraulic fluid supplied to the cylinder.

In this embodiment, as each link assembly 16, 18 comprises two pivotally connected links 30*a*, 30*b*, 32*a*, 32*b*, during this process, each of the second links 30*b*, 32*b* pivots about its connection to the corresponding first link 30*a*, 32*a*, so that the second links 30*b*, 32*b* are maintained in an orientation which is generally parallel to the longitudinal axis of the elongate body 12. This means that there is no relative angular movement of the wedge part 20 and the second end 16*b*, 18*b* of each link assembly 16, 18, so the connection between these parts need not accommodate pivoting of the wedge part 20 relative to the second end 16*b*, 18*b* of the each link assembly 16, 18.

By combining these two distinct stages of movement of the wedge part 20, the anchor device 10 can be used to engage with tubular elements having a greater range of internal diameters compared to an anchor device 10 of the same length and diameter, using a mechanism which employs only a wedging or a pivoting movement.

It will be appreciated that when the fluid pressure in the cylinder is released, the piston 17 moves under the action of the resilient biasing element to return to its retracted position, and the link assemblies 16, 18 return to their straight configuration carrying out the movement described above, but in reverse.

In an alternative embodiment of the invention, illustrated in FIG. 8-15, a different configuration of linkage 14' is employed. As best illustrated in FIG. 13, in this embodiment, each linkage 14' comprises three links 34, 36, 38, the first link 34 being pivotally connected to the first body portion 12*a*, the third link 38 being pivotally connected to the piston 17, and the second link 36 being pivotally connected to both the first 34 and third 38 links. The anchor face 13' is provided on a radially outwardly facing face of the second link 36. In this embodiment, the anchor face 13' is provided with a plurality of grooves which extend generally perpendicular to the longitudinal axis A of the body 12, and have a zig-zag transverse cross-section. These grooves may be provided over all or a substantial portion of the radially outwardly facing face of the second link 36. In this particular embodiment, however, the grooves are provided in two separate groups positioned at opposite ends of the second link 36. This is illustrated best in FIGS. 13 & 14.

The first 34 and third 38 links are of generally equal length, and so the second link 36 is located generally centrally between the first body portion 12*a* and the piston 17, as is illustrated in FIG. 13.

As with the first embodiment of the invention, the linkages 14' are provided with a resilient biasing assembly, in this embodiment a helical tension spring, which biases the links 34, 36, 38 to a straight configuration in which the first link 34, second link 36 and third link 38 are substantially aligned and all are generally parallel to the longitudinal axis of the elongate body 12. When the piston 17 is in a retracted position, the separation of the first body portion 12*a* from the piston 17 is at a maximum, the linkages 14' are in their straight configuration, as is illustrated in FIGS. 9, 10*a* & 10*b*.

A detailed side view of the first link 34 and part of the first body portion 12*a* and second link 36 when in their straight configuration is illustrated in FIG. 15*a*, and this shows that pivot axis X of the connection between the first link 34 and the first body portion 12*a* is closer to the longitudinal axis of the body portion 12 than the pivot axis Y of the connection between the first link 34 and the second link 36. As such, the line between the pivot axis X of the connection between the first link 34 and the first body portion 12*a*, and the pivot axis Y of the connection between the first link 34 and the second link 36 is inclined relative to the longitudinal axis A of the body portion 12. The angle of inclination is small—typically less than around 5° (3.3° in one embodiment), and the links 34, 36 are configured to prevent the first link 34 from pivoting to move the pivot axis Y any closer any closer to the longitudinal axis A of the body portion 12. In this example, this is facilitated by the provision of an inclined bottoming shoulder 36*a* on the second link 36 which engages with a corresponding shoulder 34*a* on the first link 34. These bottoming shoulders 34*a*, 36*a* are provided on the radially outermost sides of the links 34, 36, and are illustrated in FIGS. 15*a* and 15*b*.

The links 34, 36 are also configured so as to prevent pivoting of the first link 34 about axis X in the other direction (i.e. so that axis Y moves away from the longitudinal axis A) beyond a predetermined limit, typically around 45°. In this embodiment, this is facilitated by providing the first link 34 with a further inclined bottoming shoulder 34*b* which, when the first link 34 has pivoted about axis X from its straight configuration through the desired maximum pivot angle θ, engages with a corresponding further shoulder on the second link 36, as is illustrated in FIG. 15*b*. In this particular embodiment, the maximum pivot angle θ of the first link 34 is 45.68°.

The third link 38 is configured in exactly the same way as the first link 34, and its angular position is limited in the same manner.

As with the first embodiment, the anchor device 10' is provided with three linkages 14', which are regularly spaced around the elongate body 12. This is best illustrated in FIG. 18, which shows an end view of the anchor device 10'. It will be appreciated, however, that this need not be the case, and fewer or more pairs may be used.

It will be appreciated that this limitation of the angular position of the first link 34 could equally achieved by other means, such as the engagement of the first link 34 with appropriate formations on the first body portion 12*a*.

In this embodiment, the movement of the linkages 14' is also limited by the provision of at least one stop element 74, which extends from the first body portion 12*a* towards the piston 17, and engages with the piston 17 when the linkages 14' are extended to the maximum desired extent (i.e. the spacing between the piston 17 and the first body portion 12*a* is at a desired minimum), to prevent any further movement of the piston 17 towards the first body portion 12*a*. In this example, three stop elements 74 are provided—one between each adjacent pair of linkages 14'. In this example, the stop elements 74 are rods which lie with their longitudinal axes generally parallel to the longitudinal axis A of the body portion 12. These stop elements can be seen in FIGS. 8, 9, 10*a*, 11, 12*a* and 16.

In this embodiment, the anchor device 10' is provided in a module with a one further anchor device 10', the second body portion 12*b* of the first anchor device 10' providing the first body portion 12*a* of the second anchor device 10', as is illustrated in FIG. 8. It will be appreciated, of course, that, in the same way as with the first embodiment, only one anchor device 10' or more than two anchor devices 10' may be provided in a module.

This embodiment of anchor device 10' is operated in a very similar manner to the first embodiment.

As the piston 17 moves from its retracted position, the initial movement of the piston 17 towards the first body portion 12*a* causes the first link 34 and third link 36 to pivot about their connections to the first body portion 12*a* and piston 17 respectively. Because, in both cases, the pivot axis of their pivotal connection to the second link 36 is radially outward relative to the pivot axis of their pivotal connection the first body portion 12*a* and piston 17 respectively, the first link 34 and third link 36 pivot so as to push the second link 36 away from the longitudinal axis A of the body portion 12. Moreover, as the first link 34 and third link 36 are substantially identical in size and configuration, the second link 36 remains generally parallel to the longitudinal axis A of the body portion 12 during this process. This is illustrated in FIGS. 11, 12*a* & 12*b*.

As a result of this movement, the anchor faces 13' provided on the outermost face of each of the second links 36 may come into engagement with the interior surface of the tubular element in which the anchor device 10 is located, this engagement locking the anchor device 10 in the tubular element. The force with which the second links 36 are pushed against the tubular element, and hence the force required to dislodge the anchor device 10' and move it along the tubular element can be increased by increasing the pressure of the hydraulic fluid supplied to the cylinder.

Again, when the fluid pressure in the cylinder is released, the piston 17 moves under the action of the resilient biasing element to return to its retracted position, and the linkages 14' return to their straight configuration carrying out the movement described above in reverse.

It will be appreciated that if the inner diameter of the tubular element is too large relative to the outer diameter of the anchor device 10', the anchor faces 13' will not reach the inner surface of the tubular element before the first and third links 34, 38 reach the limit of their outward rotation. In this case, the anchor device 10' cannot be used as an anchor in this diameter of tubular element.

In a preferred embodiment of the invention, the range of diameters of tubular elements with which the anchor device 10' can be used, is increased by providing a plurality of sets of interchangeable linkages 14'. In this case, the pivotal connection between the first link 34 and the first body portion 12' and between the third link 38 and the piston 17 is releasable, so the linkages 14' can be removed, and each replaced with a different linkage 14', the same body 12 being used in each case.

The releasable pivotal connection between the first link 34 and the first body portion 12' and between the third link 38 and the piston 17 may, for example, be made using threaded or retained pins, which permit the linkages 14' to be swapped on site, without dismantling any other part of the anchor device 12'.

The total length of the linkages 14' remains the same in all the sets, but the length of the first link 34 and third link 38 (x) relative to the length of the second link 36 (y) changes. An example of a linkage 14*a*', 14*b*', 14*c*' from each one of three sets of links is illustrated in FIG. 14.

It will be appreciated that an increase in the length of the first and third links 34, 38 increases the distance from the longitudinal axis of the body 12 the second link 36 can move, and so increases the differential between the outer diameter of the anchor device 12' and the inner diameter of the tubular element in which the anchor device 12' can be used.

The linkages 14' may be classified in accordance to the relative length of the first and third links 34, 38 to the second link 36. An example of such classification is set out in Table 1 below.

TABLE 1

| Linkage Class (CL) | Second link length x (mm) | First and third link length y (mm) | Scissor Ratio x/y (Rs) |
|---|---|---|---|
| 1 | 184 | 25.03 | 7.35 |
| 2 | 144 | 45.02 | 3.20 |
| 3 | 104 | 65.02 | 1.60 |

It will be appreciated that the maximum interior diameter of the tubular element with which such an anchor device 10' can engage is determined by the length of the first and third links 34, 38 and the maximum pivot angle θ of these links. As discussed above, in the present embodiment, the maximum pivot angle θ is 45.68°, and with the link lengths set out in Table 1 above, this means that the maximum interior diameter of tubular element with which each class of linkage 14 can operate is as in Table 2 below.

TABLE 2

| Linkage Class (CL) | Min ID (mm) | Min Effective ID (mm) | Max ID (mm) |
|---|---|---|---|
| 1 | 80 | 95 | 113.46 |
| 2 | 80 | 110 | 141.26 |
| 3 | 80 | 135 | 172.64 |

By virtue of providing these three sets of linkage 14', the anchor device 10' can be used with the full range of tubes between 4½" and 7" used in most wells around the world. All such tubings listed in the API Specification 5CT/ISO 11960 Standard, and their corresponding linkage class are listed in FIG. 19.

Examples of the force with which the anchor device 10' can grip the tubular element, based on the inner diameter of the tubular element, the number of anchor modules, and the hydraulic pressure in the cylinders, are shown in Table 4 below.

TABLE 4

| Input | | Output | |
|---|---|---|---|
| Tubing ID | 135 mm | Linkage Class | CL 3 |
| No. anchor modules | 3 | | |
| Hydraulic pressure | 1846 Psi | Grip | 12657 Lbf |
| Tubing ID | 141.62 mm | Linkage Class | CL 3 |
| No. anchor modules | 2 | | |
| Grip | 35000 Lbf | Hydraulic Pressure | 6669 Psi |

Referring now to FIGS. 16, 17 and 18, these show the details of one embodiment of piston 17 and cylinder by means of which the anchor devices 10, 10' described above may be operated. These figures show the second embodiment of anchor device 10' described above, but it should be appreciated that this piston arrangement could equally be applied to the first embodiment of anchor device 10.

The hydraulic flow paths in the anchor device 10' can be seen, at least in part, in FIGS. 16 and 17. These show that the first body portion 12*a* of the elongate body 12 is generally cylindrical, and has a central passage in which a first end of the rod 12*c* (hereinafter referred to as mandrel 12*c*) is lodged. Appropriate seals (in this example O-rings) are provided to ensure a substantially fluid tight seal between the first end of the mandrel 12*c* and the first body portion 12*a*.

The second body portion 12*b* of the elongate body 12 is tubular, the piston 17 being provided at a first end thereof, the second end being closed using a cylindrical end cap 40 which fits inside the tubular second body portion 12*b*. Appropriate seals (in this example O-rings) are provided to ensure a substantially fluid tight seal between the end cap 40 and the second body portion 12*b*. The end cap 40 also has a generally central passage in which a second end of the mandrel 12*c* is lodged. Again, appropriate seals (in this example O-rings) are provided to ensure a substantially fluid tight seal between the end cap 40 and the second end of the mandrel 12*c*.

A fluid supply passage 42, anchor drain line 44 and actuation control line 46 are all provided in the mandrel 12*c*, and extend from the first end to the second end of the mandrel 12*c*. In this embodiment, all are generally cylindrical passages, which extend, generally parallel to one another and to the longitudinal axis of the mandrel 12*c*.

In this embodiment, the anchor drain line 44 has the largest diameter and extends generally centrally around the longitudinal axis of the mandrel 12*c*. An anchor drain inlet port 48 is a passage which extends through the end cap 40 from an outer end face thereof to an inner end face thereof, directly adjacent to the anchor drain line 44 in the mandrel 12*c*, as illustrated in FIGS. 16 and 17, so as to provide a continuous flow passage between the anchor drain line 44 and the anchor drain inlet port 48. The anchor drain inlet port 48 can also be seen in the end view of the anchor device 10' illustrated in FIG. 18.

The fluid supply passage 42 and actuation control line 46 have smaller diameters and are located radially outwardly of the anchor drain line 44. An anchor supply outlet port 50 and actuation control inlet port 52 are passages which extend through the end cap 40 from an outer end face thereof to an inner end face thereof, directly adjacent to the fluid supply passage 42 and the actuation control line 46 respectively, so as to provide continuous flow passages between the anchor supply outlet port 50 and fluid supply passage 42, and the actuation control inlet port 52 and actuation control line 46 respectively. These are not visible in the cross-sections illustrated in FIGS. 16 and 17, but can be seen in the end view illustrated in FIG. 18.

Similar passages extend through the outermost end of the first body portion 12*a* from an anchor supply inlet port, an anchor drain outlet port 56, and an actuation control outlet port to the fluid supply passage 42, anchor drain line 44 and actuation control line 46 respectively at the first end of the mandrel 12*c*.

Non-return check valves are provided at each of the anchor drain inlet port 48, anchor supply outlet port 50, actuation control inlet port, anchor supply inlet port, anchor drain outlet port 56 and actuation control outlet port, which are arranged to permit flow of flow past the valve into the fluid passage 42, anchor drain line 44, or actuation control line 46, but to prevent flow of fluid across the valve in the opposite direction. Of these, only the check valve 68 at the anchor drain inlet port 48 can be seen in FIGS. 16, 17 & 18.

The remainder of the tubular second body portion 12*b* which is not filled with the end cap 40 forms the cylinder 60 of the anchor actuator. The piston 17 is annular and is mounted around the mandrel 12*c*. Seals are provided between a radially inward facing surface of the piston 17 and the mandrel 12*c*, and between a radially outward facing surface of the piston 17 and the cylinder 60, these seals being substantially fluid tight whilst allowing the piston 17 to reciprocate with the cylinder 60. The resilient biasing assembly in this example is a helical return spring 62 which also surrounds the mandrel 12*c*, and extends between the end cap 40 and the piston 17. An actuation chamber 64 is formed inside the cylinder 60 between the end cap 40 and the piston 17. The other end of the cylinder 60 is open, and so the other side of the piston 17 is exposed to atmospheric pressure (e.g. well bore pressure when the anchor device is in use).

The actuation chamber 64 is connected to the actuation control line 46 in the mandrel 12*c* by means of a cross-passage 66 which extends through the mandrel 12*c* from the actuation control line 46 at generally right-angles thereto, and into the actuation chamber 64, as is best illustrated in FIG. 17. As such, supply of pressurised fluid to the actuation chamber 64, and thus the application of the anchor 10', may be achieved by directing pressurised fluid into the actuation control line 46 via either the actuation control inlet port 72 or outlet port.

In one embodiment of the invention, a source of pressurised fluid such as a hydraulic module including a fluid pump and reservoir of pressurised fluid may be connected to the first body portion 12*a* of the anchor 10' so that pressurised fluid from the hydraulic module is directed to the fluid supply passage 42 via the anchor supply inlet port 52. Furthermore, the flow of pressurised fluid from the fluid supply passage 42 to the actuation control line 46 can be controlled by a control module which is mounted on the second body portion 12*b*, the control module providing a control connection between the fluid supply passage 42 (via the anchor supply outlet port 50) and the actuation control line 46 (via the actuation control inlet port 72), and a engage valve assembly which is operable to permit or prevent flow of fluid along this control connection.

The control module is configured such that, when it is mounted on the second body portion 12*b*, it opens the non-return check valves are provided at each of the anchor drain inlet port 48, anchor supply outlet port 50, actuation control inlet port. Moreover, the hydraulic module is configured such that, when it is mounted on the first body portion 12*a*, it opens the non-return check valves provided at the anchor supply inlet port, anchor drain outlet port 56.

In order to release pressurised fluid from the actuation chamber 64 to enable the piston 17 to return to its retracted position, the actuation chamber 64 must be connected to a low pressure region such as a hydraulic fluid reservoir. In one embodiment, the low pressure region to which fluid from the actuation chamber 64 is drained as the piston 17 moves its retracted position is provided in the hydraulic module, and is the reservoir from which the fluid pump draws. The anchor drain line 44 is connected to the reservoir via the anchor drain outlet port 56, and the control module provides a drain connection between the anchor drain line 44 (via the anchor drain inlet port 48) and the actuation control line 46 (via the actuation control inlet port 72), and a drain valve assembly which is operable to permit or prevent flow of fluid along this drain connection.

The valves in the engage valve assembly and drain valve assembly may be electrically operable, and, in this embodiment, electrical lines which are used to supply electrical power to these valves also extend along the anchor drain line 44. These extend to electrical connectors 70 provided in the outer end face of the end cap 40 (illustrated in FIGS. 17 and 18), which, when the anchor 10' is connected to a control module, engage with corresponding electrical connectors provided on the adjacent face of the control module. Similarly, the first body portion 12*a* is provided with electrical connectors to connect the electrical lines extending along the anchor drain line 44 with corresponding electrical connectors 72 provided on the hydraulic module, these connectors being shown in FIGS. 16 and 17.

The invention claimed is:

1. An anchor device having a tubular body with a longitudinal axis, the tubular body being divided into a first body portion and a second body portion which are interconnected by means of a rigid connection so that movement between the first body portion and second body portion is substantially prevented, the anchor device further comprising an actuator having an actuation part which, by operation of the actuator, moves relative to the body, wherein the anchor device further comprises a first linkage set and second linkage set each of which includes at least one linkage, each linkage comprising a first, second and third link, the second link lying between the first and third links, and being pivotally connected to both, each linkage further comprising means to releasably pivotally connect the first link to the first body portion, and means to releasably pivotally connect the third link to the actuation part, the first and third links of each linkage in the first set being shorter than the first and third links of each linkage in the second set, and the second link of each linkage in the first set being longer than the second link of each linkage in the second set.

2. The anchor device according to claim 1 wherein the lengths of the links in each linkage is set such that the total length of the linkage set when the links are extended so that the separation between the end of the first link which is adapted to be releasable connected to the first body portion, and the end of the third link which is adapted to be releasably connected to the actuation part is at its maximum, is substantially the same for the first linkage set and the second linkage set.

3. The anchor device according to claim 1 wherein the second link of each linkage has an anchor face mounted thereon.

4. The anchor device according to claim 1 wherein the anchor face is provided with a plurality of striae which extend generally perpendicular to the longitudinal axis of the body.

5. The anchor device according to claim 1 wherein the actuator is configured such that movement of the actuation part relative to the body is translational movement.

6. The anchor device according to claim 1 wherein the actuator is operable to move the actuation part generally parallel to the longitudinal axis of the body in order to move the anchor face in a direction generally perpendicular to the longitudinal axis of the body.

7. The anchor device according to claim 1 wherein the actuator comprises a piston and cylinder, the cylinder being fixed to the second body portion and the piston being movable relative to the cylinder towards or away from the first body portion.

8. The anchor device according to claim 1 wherein the first and third links of each linkage are of generally equal length, so that when the linkage is connected between the first body portion and the actuation part, the second link is located generally centrally between the first body portion and the actuation part.

9. The anchor device according to claim 1 wherein the linkage is provided with a resilient biasing assembly, which biases the links to a straight configuration in which the links are substantially aligned and are generally parallel to the longitudinal axis of the body when the linkage is connected between the first body portion and the actuation part.

10. The anchor device according to claim 1 wherein the anchor device is configured such that when the actuation part is in a retracted position, and the separation of the first body portion from the actuation part is at a maximum, the linkage is in its straight configuration.

11. The anchor device according to claim 1 wherein the rigid connection between the first body portion and the second body portion comprises a rod which extends along the longitudinal axis of the body.

12. The anchor device according to claim 1 wherein the anchor device is provided with connections for a plurality of linkages which are spaced around the longitudinal axis of body.

13. The anchor device according to claim 1 wherein at least one stop is provided on either the actuation part or the first body portion, the stop being configured to engage with the other of the actuation part or first body portion when the separation of the actuation part and the first body portion is at a desired minimum, to prevent any further movement of the actuation part towards the first body portion.

14. The anchor device according to claim 1 wherein the linkages are configured such that, when a linkage is connected between the first body portion and the actuation part, the pivot axis of the connection between the first link and the first body portion and the pivot axis of the connection between the third link and the actuation part are closer to the longitudinal axis of the body than the pivot axis of the connections between the second link and the first and third links.

15. An anchor device assembly comprising a module containing two anchor devices, each anchor device having a tubular body with a longitudinal axis, the tubular body being divided into a first body portion and a second body portion which are interconnected by means of a rigid connection so that movement between the first body portion and second body portion is substantially prevented, the anchor device further comprising an actuator having an actuation part which, by operation of the actuator, moves relative to the body, wherein the anchor device further comprises a first linkage set and second linkage set each of which includes at least one linkage, each linkage comprising a first, second and third link, the second link lying between the first and third links, and being pivotally connected to both, each linkage further comprising means to releasably pivotally connect the first link to the first body portion, and means to releasably pivotally connect the third link to the actuation part, the first and third links of each linkage in the first set being shorter than the first and third links of each linkage in the second set, and the second link of each linkage in the first set being longer than the second link of each linkage in the second set.

16. The anchor device assembly according to claim 15 wherein the second body portion of a first anchor device provides the first body portion of a second anchor device.

* * * * *